US011517155B2

(12) United States Patent
Ahuja et al.

(10) Patent No.: US 11,517,155 B2
(45) Date of Patent: Dec. 6, 2022

(54) DRAIN FLANGE COVER AND STRAINER

(71) Applicant: PF Waterworks LP, Houston, TX (US)

(72) Inventors: Sanjay Ahuja, Katy, TX (US); Harold Kent Beck, Copper Canyon, TX (US)

(73) Assignee: PF Waterworks LP, Houston, TX (US)

( * ) Notice: Subject to any disclaimer, the term of this patent is extended or adjusted under 35 U.S.C. 154(b) by 136 days.

(21) Appl. No.: 15/913,452

(22) Filed: Mar. 6, 2018

(65) Prior Publication Data

US 2018/0263426 A1 Sep. 20, 2018

Related U.S. Application Data

(60) Provisional application No. 62/588,778, filed on Nov. 20, 2017, provisional application No. 62/474,058, filed on Mar. 20, 2017.

(51) Int. Cl.
*A47K 1/14* (2006.01)
*E03C 1/23* (2006.01)

(52) U.S. Cl.
CPC ..... *A47K 1/14* (2013.01); *E03C 1/23* (2013.01); *E03C 1/2302* (2013.01); *E03C 1/2306* (2013.01); *E03C 2001/2317* (2013.01)

(58) Field of Classification Search
CPC ..... A47K 1/14
USPC ..... 4/291, 287, 292
See application file for complete search history.

(56) References Cited

U.S. PATENT DOCUMENTS

| | | | | |
|---|---|---|---|---|
| 2,075,443 | A * | 3/1937 | Kirschner | E03C 1/262 4/287 |
| 2,475,048 | A * | 7/1949 | Pokras | A01J 9/04 210/244 |
| 4,207,631 | A * | 6/1980 | Baggey | E03C 1/264 4/286 |
| 5,265,281 | A * | 11/1993 | McAlpine | E03C 1/262 4/287 |
| 5,363,518 | A | 11/1994 | Mowery | |
| 6,067,669 | A | 5/2000 | Peterson et al. | |
| 6,263,518 | B1 * | 7/2001 | Magtanong | E03C 1/26 4/286 |
| 8,011,030 | B2 * | 9/2011 | Li | E03C 1/262 4/286 |
| 8,813,272 | B2 | 8/2014 | Ball | |
| 9,453,329 | B2 | 9/2016 | Ball | |
| 9,585,523 | B1 | 3/2017 | Brannan | |
| D783,134 | S | 4/2017 | Karnegie | |
| D785,767 | S | 5/2017 | Karnegie | |
| D794,759 | S | 8/2017 | Karnegie et al. | |
| 9,745,728 | B2 | 8/2017 | Beck et al. | |
| 2004/0073992 | A1 | 4/2004 | Saman et al. | |
| 2005/0223481 | A1 * | 10/2005 | Giacomi | A47K 1/14 4/286 |

(Continued)

*Primary Examiner* — Lauren A Crane
(74) *Attorney, Agent, or Firm* — Stephen S. Hodgson

(57) ABSTRACT

A drain flange cover is provided for covering and hiding a drain flange in a sink or bathtub, which includes a drain cap and which may or may not include a longitudinal shaft and/or a strainer. The longitudinal shaft can be a perforated tube that serves as a strainer. Strainers can be cylindrical, regular-funnel shaped and inverted-funnel shaped. A drain stopper includes an open-close mechanism, a strainer and a drain flange cover. A drain stopper with a push-push mechanism can rest on a cross-member in a drain pipe, allowing easy removal to clean the strainer.

18 Claims, 11 Drawing Sheets

(56) References Cited

U.S. PATENT DOCUMENTS

| | | | | |
|---|---|---|---|---|
| 2013/0269100 | A1 | 10/2013 | Ball et al. | |
| 2017/0073949 | A1* | 3/2017 | Karnegie | E03C 1/264 |
| 2017/0260724 | A1 | 9/2017 | Beck et al. | |
| 2018/0274218 | A1* | 9/2018 | Karnegie | E03C 1/262 |

* cited by examiner

FIG. 10
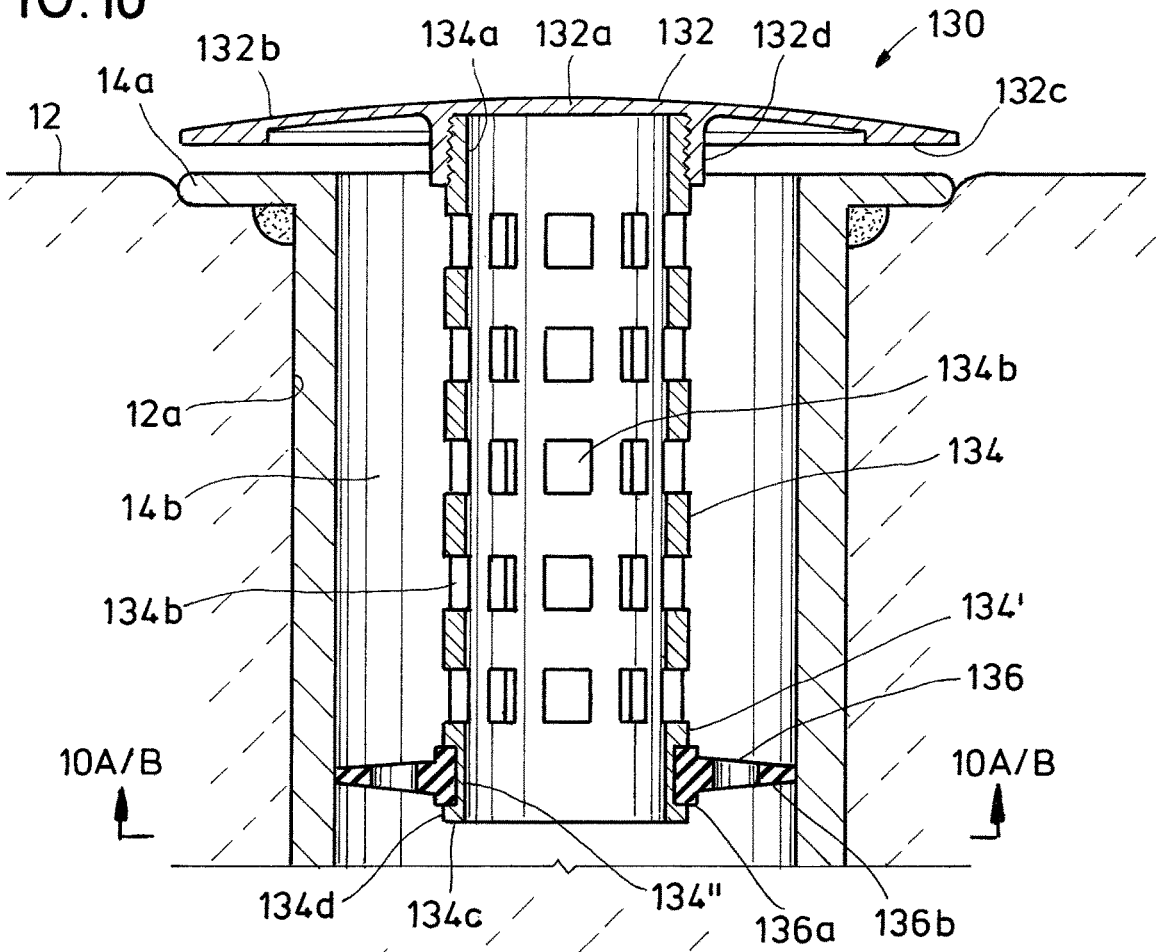
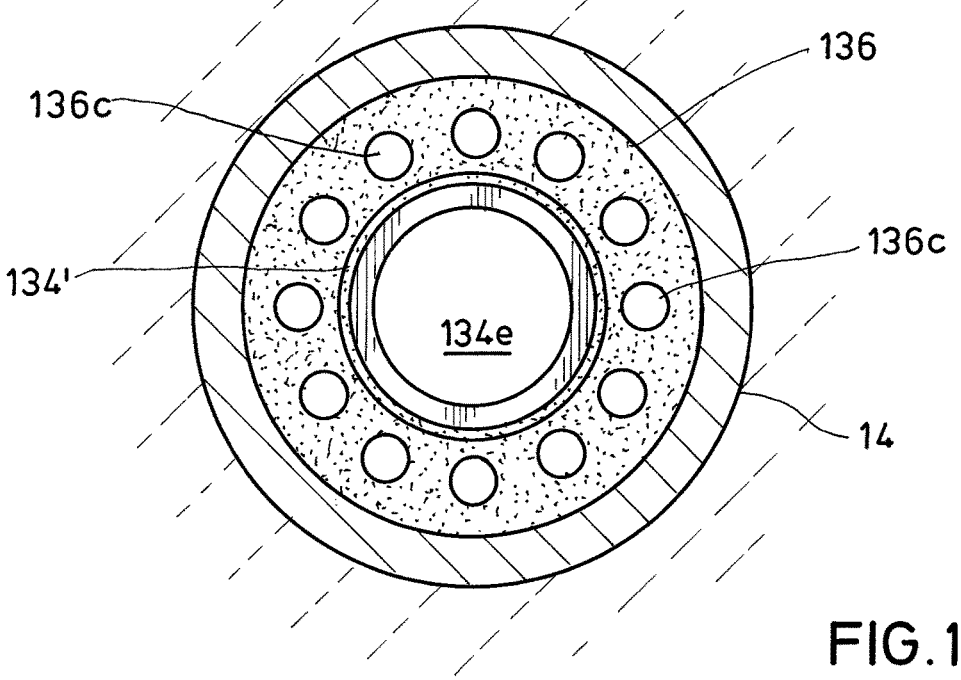
FIG. 10A 170
172
152
154a
150f
152a
156c'
156c
156
150e
150m
13D
160
13C
154b
158a
158
154
150g
156d
156a
150e
13D
13C
150g
156c'
156d
154
154e
150n
158
154b
158c
154d
152a
150f
156c
154c
156b
160
154f
154
154c
156
156d
154e
150g
150m
154
158
158c
154d
154f
154
158c
154b
154c

DRAIN FLANGE COVER AND STRAINER

CROSS REFERENCE TO RELATED APPLICATIONS

This application claims priority to and the benefit of U.S. Provisional Patent Application Ser. Nos. 62/474,058, filed Mar. 20, 2017, and 62/588,778 filed on Nov. 20, 2017, each of which is incorporated by reference. This application is related to U.S. patent application Ser. Nos. 15/584,027, 15/584,030 and 15/584,032, each of which was filed on May 2, 2017, and each of which is incorporated by reference.

BACKGROUND OF THE INVENTION

1. Field of the Invention

The present invention pertains to drains from sinks and bathtubs, which have drain flanges, and more particularly to covering and hiding the drain flanges, optionally while also providing a strainer in a drain pipe.

2. Description of the Related Art

In a lavatory or bathroom sink or basin equipped with a supply of running water for washing oneself, a pop-up drain assembly allows one to retain water in the sink or basin and then release the water to flow by gravity downwardly through a drain pipe. The sink or basin has an opening at a lowermost point, and a typical pop-up drain assembly comprises a drain conduit sealingly fastened to the sink or basin within the opening, where a drain flange surrounds an upper side of the opening. A drain stopper is received in the drain conduit for sealing the opening and retaining water in the sink or basin. A pivot rod protrudes into the drain conduit and engages a bottom portion of the drain stopper. A lift rod is connected to the pivot rod. One can pull the lift rod up to pull the drain stopper down for sealing the opening in the bottom of the sink or basin for retaining water, and one can push the lift rod down to raise the drain stopper, which unseals the drain stopper and allows water to drain from the sink or basin. U.S. Pat. No. 4,807,306, issued to Hayman et al., illustrates quite well the components in a typical prior art pop-up drain assembly and is incorporated by reference for all purposes.

U.S. Pat. No. 5,363,518, issued to Mowery, recognized that one may wish to change the appearance of a pop-up drain assembly. An existing finish may have become worn, damaged, tarnished or discolored, or one may merely wish to change the color of the finish. Effort and expense is required to completely replace the pop-up drain assembly. Mowery describes a pop-up drain stopper with a decorative cap that can be used in an existing drain conduit for changing or improving the appearance of a pop-up drain assembly. However, there continues to be a need for a simple and cost-effective means for changing or improving the appearance of a pop-up drain assembly and for changing or improving the appearance of a drain assembly in a bathtub. There also continues to be a need for a strainer in a drain pipe to catch hair, debris and objects.

SUMMARY OF THE INVENTION

The present invention provides in one embodiment a drain flange cover. Water in a sink or bathtub drains into a drain pipe through a drain opening. The drain pipe has a drain flange above and surrounding the drain opening, which is typically visible and which typically matches the finish of an associated faucet. One may wish to change the appearance of the drain flange, such as for a change in the finish or because the finish no longer looks good, but that requires removal and replacement of at least the drain flange. The drain flange cover can be used to cover and hide the drain flange rather than removing and replacing the drain flange. The drain flange cover may also include a strainer for removing hair, debris and objects out of the water as it drains from the sink or bathtub.

A drain flange cover and strainer in one embodiment of the invention includes a cap, a perforated tubular shaft depending from an underside of the cap, a gasket holder on the lower end of the shaft and a gasket on the gasket holder. The cap has an upper and outer surface and an opposing underside. A perforated tubular shaft projects downwardly from the underside of the cap. An upper end of the shaft is attached to or formed integral with the cap, and an opposing lower end is open or has openings through which water can flow. The perforated tubular shaft serves as the strainer and has openings sized and designed to filter out hair, debris and objects while allowing water to pass through the openings into the interior of the perforated tubular shaft. The gasket holder is attached to or formed integral with the lower end of the shaft and is preferably a disk that obstructs the flow of water through the drain pipe, except it preferably has openings for the flow of water downwardly from the interior of the tubular shaft. A gasket is engaged with the gasket holder and projects radially with respect to the longitudinal axis of the tubular shaft. The gasket is preferably sized and designed to touch or contact an inside wall of the drain pipe. The gasket preferably seals an annular space between the inside wall of the drain pipe and the perimeter of the disk, but may alternatively have holes in its body or notches in its perimeter, thereby enabling the gasket to also serve as a strainer. The cap preferably comprises a dome-shaped structure that is sized and designed to cover and hide the drain flange. The diameter of the cap is preferably at least 0.50 inch and more preferably at least 1.0 inch greater than the diameter of the gasket. The cap may have a low or small radius of curvature so that it does not protrude substantially above the drain flange. The cap, the perforated tubular shaft and the gasket holder are preferably rigid and are preferably made of a polymeric material.

A drain stopper for a bathtub or sink is another embodiment of the present invention. The drain stopper includes an open-close mechanism having upper and lower ends, a cap engaged with the upper end of the open-close mechanism, a seal engaged with the cap for holding water in the bathtub or sink, a disk engaged with the lower end of the open-close mechanism, and a strainer surrounding the open-close mechanism. The strainer rests on or is formed integral with or is attached to the disk. The disk preferably includes a gasket at its perimeter, which preferably seals the disk against the inside wall of a drain pipe. The strainer has an inner space defined in part by an inner surface of the strainer. The strainer has a plurality of openings through which water can flow from outside the strainer to the inner space inside the strainer. The disk has openings through which the water can drain downwardly from the inner space inside the strainer. The open-close mechanism is typically a push-push mechanism or a lift-and-lock mechanism or a lift-and-turn mechanism. The cap is preferably sized and designed to cover a drain flange and preferably has a diameter greater than the diameter of the seal, preferably at least 0.5 inch greater.

BRIEF DESCRIPTION OF THE DRAWINGS

A better understanding of the invention can be obtained when the detailed description of exemplary embodiments set forth below is considered in conjunction with the attached drawings in which:

FIG. 10 is a side elevation in cross-section of a drain flange cover having a perforated tubular shaft as a strainer basket, according to the present invention.

FIG. 10A is a cross-section of the drain flange cover of FIG. 10 as seen along the line 10A-10A.

DETAILED DESCRIPTION OF THE EXEMPLARY EMBODIMENTS

A sink and a bathtub each have a drain opening through which water can drain out of the sink or the bathtub. A drain pipe fits down through the drain opening in the sink or bathtub. The drain pipe typically has a threaded tubular portion extending essentially throughout its full length and a drain flange extends radially outwardly on a top end. The drain flange stays above the drain opening. A gasket or plumber's putty is used to provide a seal between an upper surface of the sink or bathtub and a lower surface of the drain flange. A flexible gasket and a washer are placed around a bottom portion of the drain pipe and then pressed tightly against a bottom surface of the sink or bathtub with a threaded nut.

For a sink, a drain body is threaded onto a lower end of the drain pipe. A drain stopper is received in the drain pipe for trapping water in the sink. In a pop-up drain assembly for a sink, the stopper has a cap and a gasket on an upper end for sealing against the drain flange and an elongate body that extends downwardly into the drain body. The drain body has a pivot rod port, and a threaded tubular stub projects radially outwardly from the drain body. A pivot rod seal is received in the stub. A pivot rod has a pivot ball sealingly received on the pivot rod. The pivot rod is received in the stub such that a portion of the pivot rod is inside the drain body, and the pivot ball rests against pivot rod seal. The pivot rod engages a lower end of the drain stopper for lifting the stopper up and pulling it down, thereby opening and closing the drain stopper. A pivot rod cap is threaded onto the stub to seal the pivot ball against the pivot rod seal. The pivot rod extends outwardly from the stub, and the pivot rod is in a somewhat horizontal position. A control rod has an upper end above the sink and is used to open and close the drain stopper. The control rod is in a generally vertical position and passes downwardly from above the sink through a port. A connector device is used to connect the generally vertical control rod to the generally horizontal pivot rod. One can push the control rod down to open the drain stopper and pull the control rod up to close the stopper.

A bathtub does not have the same type of pop-up drain assembly, but does have a drain pipe that has a drain flange sealed around a drain opening in the bathtub. The drain flange is visible in a sink and in a bathtub. If the drain flange for a sink or bathtub becomes worn, tarnished or damaged, or if one wants to change the color scheme or finish color for the drain flange, then a considerable effort and expense is required to change out the drain flange. The present invention concerns covering and hiding the drain flange in a sink or bathtub so that the appearance of a sink or bathtub drain can be improved or changed, without it being necessary to remove and replace the drain flange.

Figure 1A:
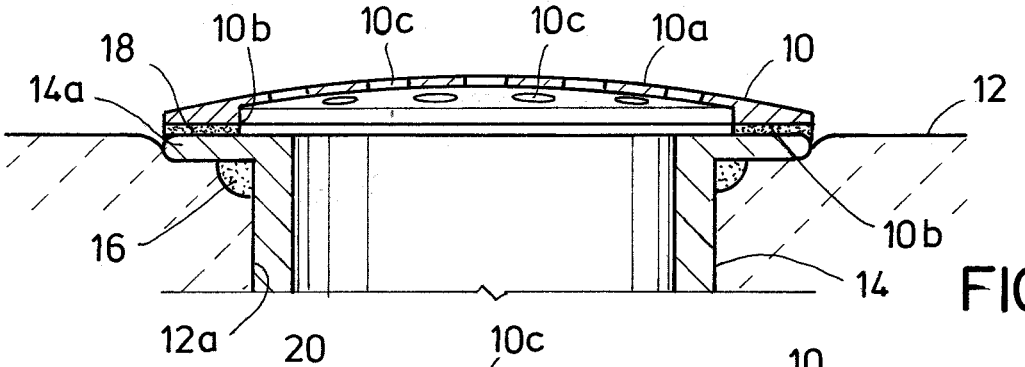
FIG. 1A is a side elevation in cross-section of a drain flange cover, according to the present invention.

Turning now to the present invention, FIG. 1A is a side elevation in cross-section of a drain flange cover 10, according to the present invention. A sink or bathtub 12 has a drain opening 12*a*. A drain pipe 14 is received in the opening 12*a* and has a drain flange 14*a* that extends radially outwardly from the longitudinal axis of the drain pipe 14 and rests on an upper surface of the sink or bathtub 12. A plumber's putty or gasket 16 seals a lower surface of the drain flange to the upper surface of the sink or bathtub 12 around the drain opening 12*a*. The drain flange cover 10 has an upper dome-shaped surface 10*a* that is convex with respect to the longitudinal axis of the drain pipe 14. The dome shape is not an essential feature, and drain flange cover 10 can have a flat, planar shape. A washer-shaped annular ring of glue 18 is bonded to and sealed with an upper surface of the drain flange 14*a*. Drain flange cover 10 has a washer-shaped annular lower surface 10*b* adjacent to its perimeter or circumference, and glue 18 is also bonded to and sealed with the annular lower surface 10*b*. Drain flange cover 10 has a diameter that is equal to or greater than the diameter of the drain flange 14*a*, preferably 5 to 15 percent and more preferably about 10 percent greater than the diameter of the drain flange 14*a*. Drain flange cover 10 is a strainer in this embodiment and has holes or openings 10*c* that allow water to drain out of the sink or bathtub through drain flange cover 10. Drain flange cover 10 does not open or close in this embodiment and is instead fastened to the drain flange 14*a* by glue or adhesive 18. Drain flange cover 10 can be made of a metal and have a finish such as chrome, polished chrome, brushed chrome, bronze, oil-rubbed bronze, polished bronze, brushed nickel, polished nickel, polished brass, satin brass, satin bronze, copper, matte black and white. Drain flange cover 10 can be made of a plastic or polymeric material. A sheet of material (not shown) can cover drain flange cover 10 and provide a desired appearance. For example, a thin sheet of material having an outer surface in one of the finishes noted above can cover the upper surface of drain flange cover 10 and be wrapped under the annular lower surface 10*b*. The sheet of material can be crimped along an edge under the annular lower surface 10*b* or can be glued onto the drain flange cover 10 or both. Drain flange cover 10 can be made and sold in a variety of colors and plumbing fixture finishes, such as noted above, preferably with the layer of glue 18 and a removable film covering the glue 18 for a peel-and-stick installation on the drain flange 14. Drain flange cover 10 can have any design, such as a sports emblem or cartoon character, or color, such as red or blue, in addition to the typical plumbing finishes noted above. Drain flange cover 10 can be plated instead of having a sheet of material as a separate component. The phrase sheet of material will generally include plating and designs and colors that are made integral with the drain flange cover.

Figure 1B:
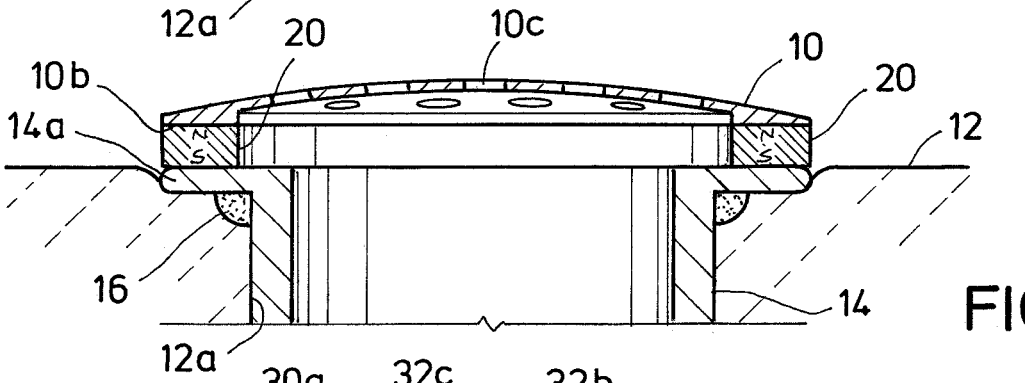
FIG. 1B is a side elevation in cross-section of a drain flange cover, according to the present invention.

FIG. 1B is also a side elevation in cross-section of the drain flange cover 10 in the sink or bathtub 12, which has the drain opening 12*a*. A washer-shaped annular ring 20 is a magnet for removably fastening the drain flange cover 10 to the drain flange 14*a*. Magnet 20 can be incorporated into or can be bonded to or adhered to the washer-shaped annular lower surface 10*b* of the drain flange cover 10, or magnet 20 can be a separate piece that is at least magnetically attracted to both the drain flange cover 10 and the drain flange 14*a*. Magnet 20 is useful with drain flanges that are attracted to a magnet. Magnet 20 could be bonded or adhered to one of the drain flange cover 10 or the drain flange 14*a* and magnetically attracted to the other. For example, magnet 20 could be made and sold as a separate piece with a peel-and-stick adhesive layer for being attached to the drain flange 14*a*, and the drain flange cover 10 could be magnetically and removably attachable to the magnet 20. In either or any case, the drain flange cover 10 can be made and sold in a variety of plumbing finishes and other colors and designs, which one can purchase and use to hide and cover the drain flange 14*a*, thereby changing the appearance of the sink or bathtub drain.

FIGS. 1A and 1B describe in one embodiment an article of manufacture (a drain flange cover) for covering a drain flange surrounding a drain opening in a sink or bathtub, which comprises: a sheet of material having a circular shape, a diameter suitable for covering the drain flange, a central portion, a perimeter portion along the perimeter of the sheet of material that surrounds the central portion, a top side, a bottom side and a plurality of holes passing through the sheet of material from the top side to the bottom side that make the sheet suitable for use as a strainer; and a layer of glue or a magnet on the bottom side of the sheet of material on the perimeter portion, where there is no glue on the top side of the sheet or on the bottom side within the central portion. The diameter of the article is preferably between one and three inches. The layer of glue or the magnet has an annular shape. The article of manufacture does not have a central, longitudinal shaft extending transverse to the sheet of material.

Figure 2A:
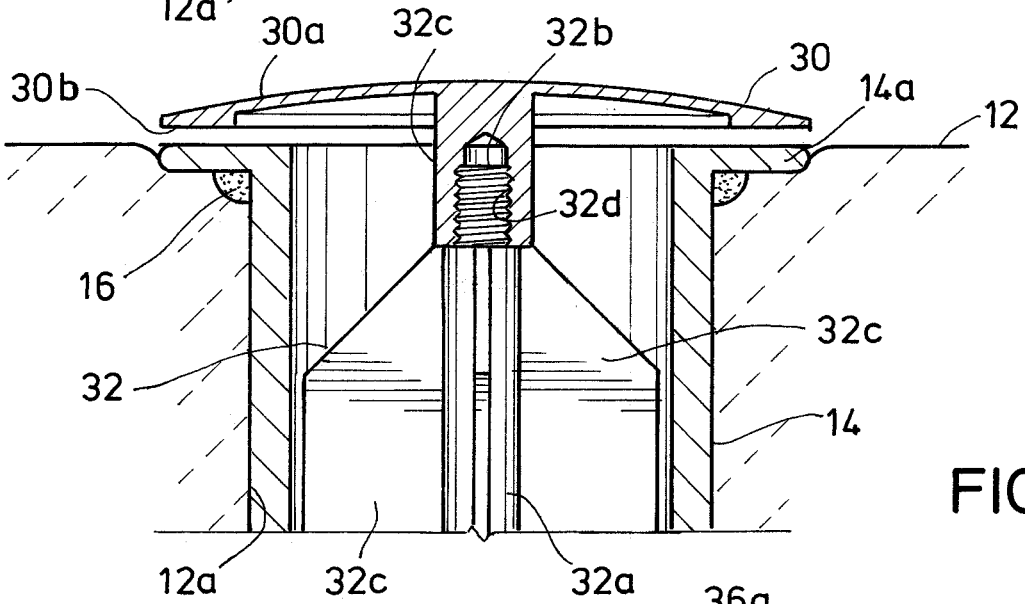
FIG. 2A is a side elevation in cross-section of a drain flange cover, according to the present invention.

FIG. 2A is a side elevation in cross-section of a drain flange cover 30 in the sink or bathtub 12, which has the drain opening 12*a* and the drain pipe 14 and drain flange 14*a*. A drain stopper 32 is received in the drain pipe 14 and has a central longitudinal shaft 32*a*, which terminates as a male-threaded stud 32*b* at its upper end, and centralizing fins 32*c*. Drain flange cover 30 has a dome-shaped upper and outer surface 30*a* and a washer-shaped annular flat ring 30*b* on a lower side along the perimeter. A tubular stub 32*c* with female threads 32*d* projects from the lower side of the drain flange cover 30 and is threaded onto the upper end 32*b* of the stopper 32. Drain flange cover 30 covers and hides drain flange 14*a*. The present inventors disclose and describe various stoppers and other information in their U.S. patent application Ser. Nos. 15/584,027, 15/584,030 and 15/584,032, which are available as Publication Nos. 2017/0260724 A1, 2017/0314244 A1 and 2017/0314245 A1, and each is incorporated by reference.

Figure 2B:
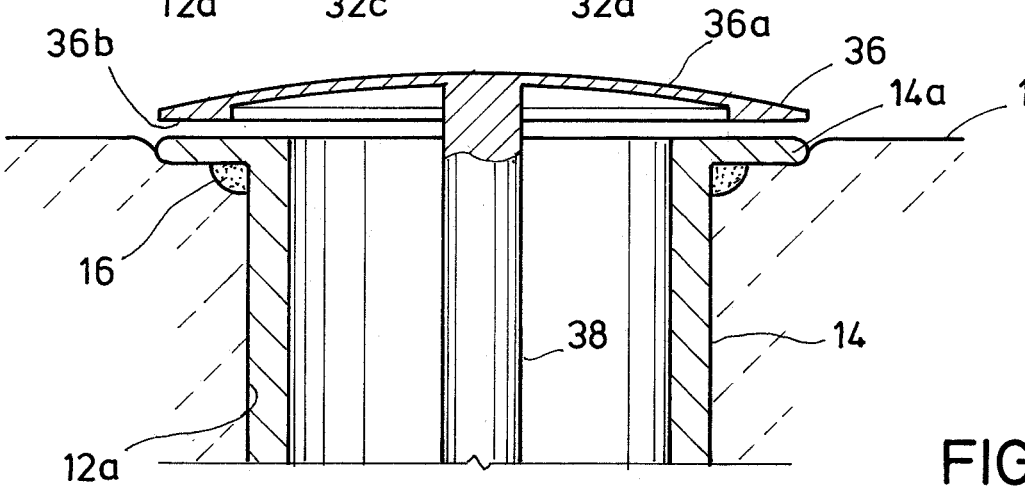
FIG. 2B is a side elevation in cross-section of a drain flange cover, according to the present invention.

FIG. 2B is a side elevation in cross-section of a drain flange cover 36 in the sink or bathtub 12, which has the drain opening 12*a* and the drain pipe 14 and drain flange 14*a*. Drain flange cover 36 has a dome-shaped upper and outer surface 36*a* and a washer-shaped annular flat ring 36*b* on a lower side along its perimeter. A central, longitudinal shaft 38 projects perpendicularly from the lower side of the drain flange cover 36. Shaft 38 may or may not be part of a drain stopper that has centralizing flanges or fins and may or may not have means for connecting to a pivot rod. The drain flange cover 30 is fixed to or formed integral with the shaft 38. Drain flange cover 36 covers and hides drain flange 14*a*.

Figure 3A:
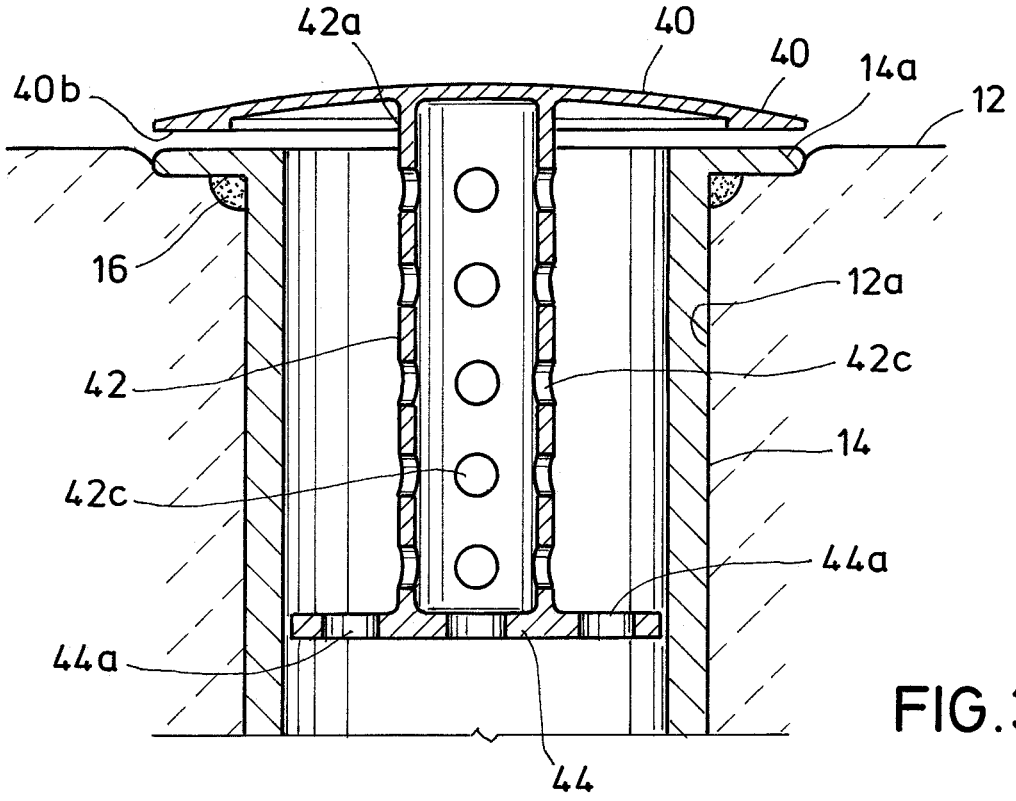
FIG. 3A is a side elevation in cross-section of a drain flange cover, according to the present invention.

FIG. 3A is a side elevation in cross-section of a drain flange cover 40 in the sink or bathtub 12, which has the drain opening 12*a* and the drain pipe 14 and drain flange 14*a*. Each of the drain flange covers described herein has a diameter that is equal to or greater than the diameter of the drain flange 14*a* and is preferably 1 to 25 percent and more preferably about 5 to 15 percent greater than the diameter of the drain flange 14*a*. Each of the drain flange covers described herein covers and hides drain flange 14*a*, which is one use for the drain flange covers. Drain flange cover 40 also serves as a strainer for removing hair, debris and objects from water that drains from the sink or bathtub 12. Drain flange cover 40 has a dome-shaped upper and outer surface 40*a* and a washer-shaped annular flat ring 40*b* on a lower side along its perimeter. A central, longitudinal, tubular shaft 42 projects perpendicularly from and has an upper end 42*a* attached to or formed integral with the lower side of the drain flange cover 40. A disc 44 is attached to a lower end 42*b* of the tubular shaft 42. Tubular shaft 42 is a hollow cylinder having a perforated wall. Numerous openings 42*c* in the tubular shaft 42 comprise the perforations and allow water to drain into the inside of the tubular shaft 42, while straining out some, most or all hair, debris and objects in the water. The disc 44 is also perforated and has a plurality of openings 44*a*. Disc 44 has opposing planar surface, like the planar surfaces of a ring-shaped, flat washer, which are perpendicular to the longitudinal axis of the tubular shaft 42. Disc 44 preferably has an opening aligned with the central open portion of the tubular shaft 42 so that it does not impede the flow of water out of the center of the tubular shaft 42 and into the drain pipe 14. Disc 44 can be sized to fit tightly, but movably, within drain pipe 14. One option includes an O-ring seal around the perimeter or circumference of the disc 44 for sealing against the inside wall of drain pipe 14. Another type of seal or gasket can be fixed to the disc 44. A tight fit between the disc 44 or an O-ring or gasket on the disc 44 and the inside wall of the drain pipe 14 can ensure that drain flange cover remains spaced above the drain flange 14*a* so that water can drain readily from the sing or bathtub 12. Standoffs or feet (not shown) can be included between the lower surface 40*b* of the drain flange cover 40 and the upper surface of the drain flange 14*a* for spacing the drain flange cover 40 from the drain flange 14*a* so that water can drain through the space provided. The standoffs or feet can be attached to or formed integral with the drain flange cover 40. Centralizer elements (not shown) can be added to the underside of the drain flange cover 40 or to the outside of the tubular shaft 42 for holding and maintaining the tubular shaft 42 in the center of the drain pipe 14, thereby ensuring that the drain flange cover 40 always covers and hides the drain flange 14*a*.

Figure 3B:
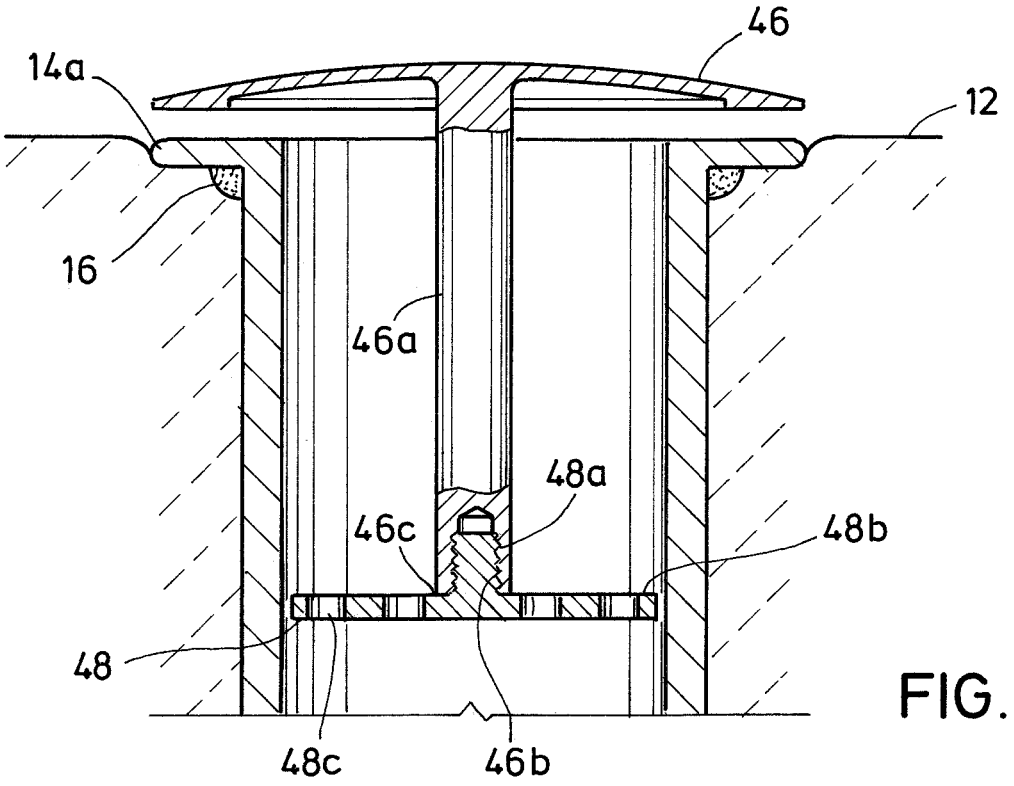
FIG. 3B is a side elevation in cross-section of a drain flange cover, according to the present invention.

FIG. 3B is a side elevation in cross-section of a drain flange cover 46 in the sink or bathtub 12, which has the drain opening 12*a* and the drain pipe 14 and drain flange 14*a*. Rather than having a tubular shaft such as shaft 42 in FIG. 3A, a solid, central, longitudinal shaft 46*a* projects perpendicularly from the underside of the drain flange cover 46. Shaft 46*a* has a central, longitudinal, threaded bore 46*b* at a lower end 46*c*. A perforated, circular disc 48 has a threaded stud 48*a* that projects perpendicularly from an upper, planar surface 48*b* of the disc 48. The disc 48 is fastened to the lower end 46*c* of the shaft 46 by screwing the stud 48*a* into the threaded bore 46*b*. A plurality of openings 48*c* provide the perforations for disc 48. Water can flow through the openings 48*c*, but hair, debris and objects tend to be retained upper surface 48*b* of the disc 48. The disc 48 serves as a strainer. Standoffs and centralizers such as described for FIG. 3A can also be used with the drain flange cover 46 in FIG. 3B. Drain flange cover 46 preferably always covers and hides the drain flange 14*a*.

FIGS. 3A and 3B describe a drain flange cover that comprises: a dome-shaped structure having an upper surface that has a curvature of a dome and an opposing lower surface, where the dome-shaped structure is sized and designed to cover and hide the drain flange; a shaft having an upper end attached to or formed integral with the dome-shaped structure and an opposing lower end, where the shaft projects perpendicular from the lower surface of the dome-shaped structure; and a disc attached to or formed integral with the lower end of the shaft, wherein the shaft projects perpendicular from the disc, where the disc is circular and has a diameter that is slightly less than the diameter of the drain opening, and where the disc has openings through which water can pass and structural elements for screening hair and debris out of the water. An O-ring is preferably included around the circumference of the disc. The disc is preferably sized and designed to seal against the inside wall of the drain pipe. In one embodiment, the shaft is a tube having a perforated tube wall so water can drain through the perforated tube wall for screening hair and debris out of the water. A sheet of a material preferably covers the upper surface of the dome-shaped structure.

Figure 4A:
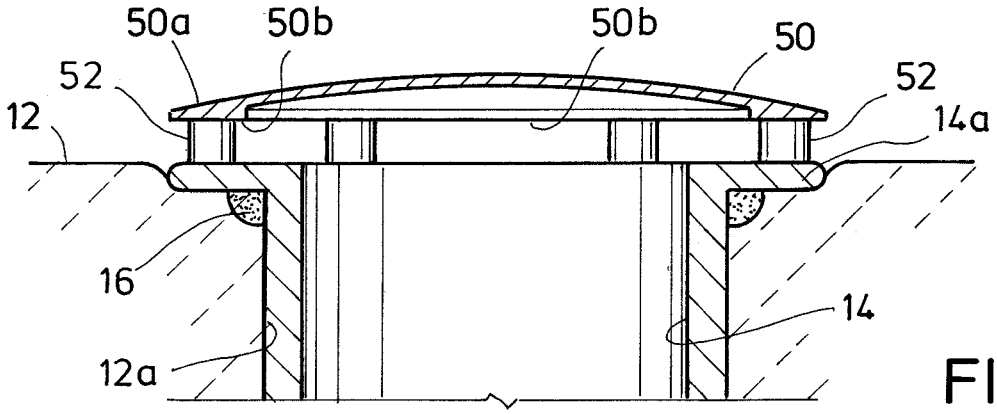
FIG. 4A is a side elevation in cross-section of a drain flange cover, according to the present invention.

FIG. 4A is a side elevation in cross-section of a drain flange cover 50 in the sink or bathtub 12, which has the drain opening 12*a* and the drain pipe 14 and drain flange 14*a*. The drain flange cover 50 has an upper dome-shaped surface 50*a* that is convex with respect to the longitudinal axis of the drain pipe 14. The drain flange cover 50 has a diameter that is equal to or greater than the diameter of the drain flange 14*a* so that the drain flange cover 50 covers and hides the drain flange 14*a*. Standoffs 52 are between a lower surface 50*b* of the drain flange cover 50 and the upper surface of the drain flange 14*a* for spacing the drain flange cover 50 from the drain flange 14*a* so that water can drain through the space provided. The standoffs 52 can be attached to or formed integral with the drain flange cover 50. A drain flange cover 54 in FIG. 4B is similar to the drain flange cover 50, except it has a set of standoffs 56 that include centering legs 56*a*, which serve as centralizing elements for keeping the drain flange cover 54 centered over the drain pipe 14 so that the drain flange 14*a* remains covered by the drain flange cover 54.

Figure 4B:
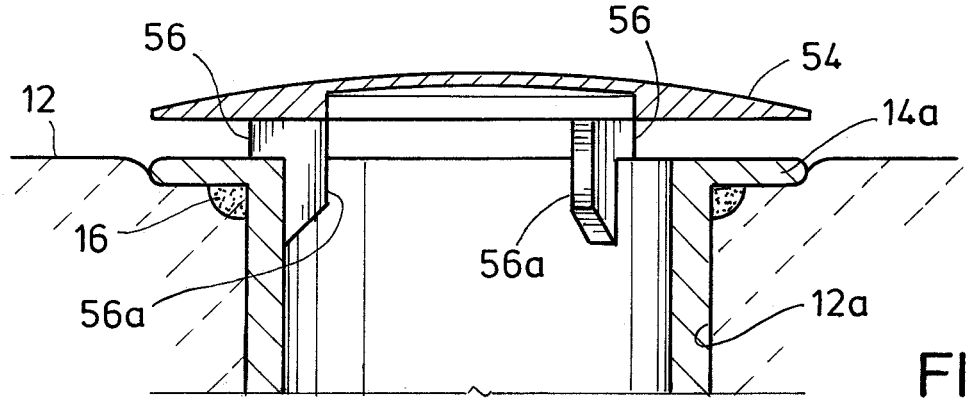
FIG. 4B is a side elevation in cross-section of a drain flange cover, according to the present invention.

FIGS. 4A and 4B describe a drain flange cover for covering a drain flange around a drain opening in a sink or bathtub, which comprises: a dome-shaped structure having an upper surface that has a curvature of a dome and an opposing lower surface, where the dome-shaped structure has a diameter of between one and three inches and is sized to cover and hide the drain flange; and two to four or so standoffs that project from the lower surface of the dome-shaped structure that are designed and sized to rest on the drain flange and space the dome-shaped structure away from the drain flange so that water can flow out of the sink or bathtub between the lower surface of the dome-shaped structure and the drain flange around the stand-offs and into the drain opening. The standoffs space the lower surface from the drain flange between 1/16 and 1/2 of an inch or between 3-5 mm and 1-2 cm. An adhesive or a magnet can be used for fastening the standoffs to the drain flange. A decorative sheet of material is preferably included for covering the upper surface of the dome-shaped structure. The sheet of material is metallic in one embodiment and is bent to lap under the lower surface for fastening the sheet of material to the dome-shaped structure. The sheet can be glued to the upper surface of the dome-shaped structure. The dome-shaped structure preferably comprises a plastic or polymeric article of manufacture, which is preferably a solid at the upper surface and preferably has a web and hollow-cell structure at its lower surface.

Figure 5A:
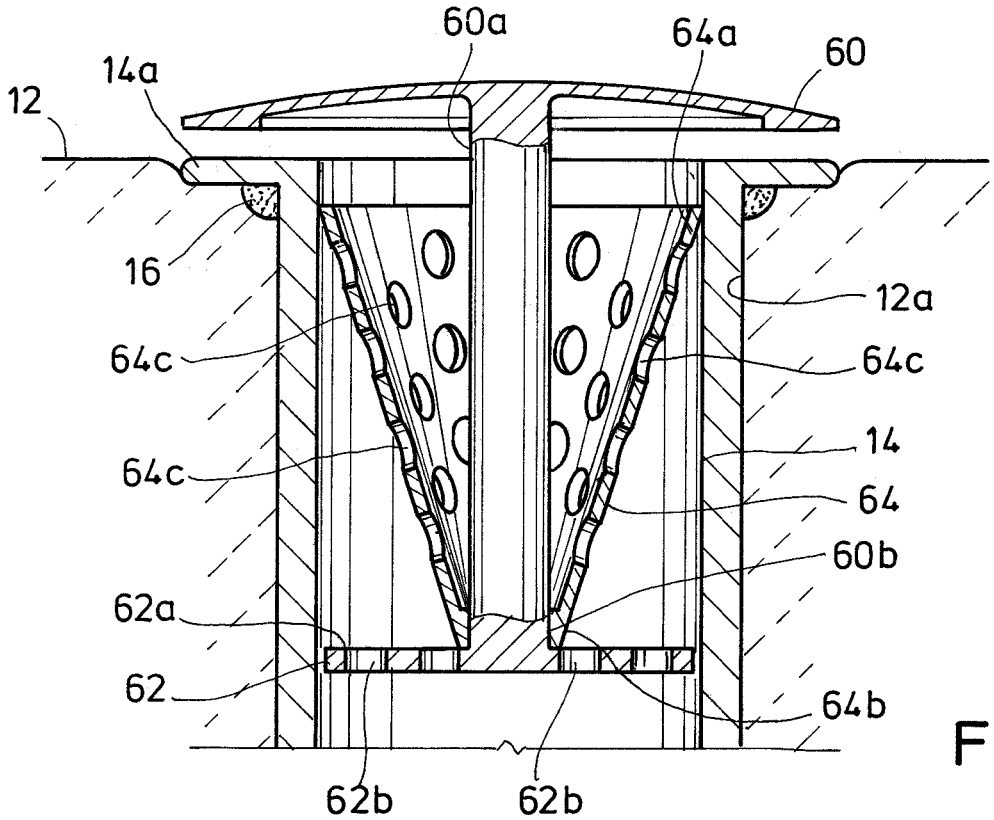
FIG. 5A is a side elevation in cross-section of a drain flange cover having a longitudinal shaft, a disk on the lower end of the shaft and a strainer basket surrounding the shaft, according to the present invention.

FIG. 5A is a side elevation in cross-section of a drain flange cover 60 in the sink or bathtub 12, which has the drain opening 12*a* and the drain pipe 14 and drain flange 14*a*. A solid, central, longitudinal shaft 60*a* projects perpendicularly from the underside of the drain flange cover 60. Rather than shaft 60*a* having a central, longitudinal, threaded bore at a lower end 60*b*, a perforated, circular disc 62 has an upper, planar surface 62*a* and is fixed to or formed integral with the lower end 60*b* of the shaft 60*a*. Disc 62 has numerous openings 62*b*, which provide the perforations. Drain flange cover 60 is similar to drain flange cover 46 in FIG. 3B, except a strainer basket 64 surrounds the shaft 60*a* and has a lower end that rests on upper surface 62*a* of the disc 62. Strainer basket 64 has the shape of a regular funnel with a large diameter at an upper end 64*a*, which fits snugly inside the drain pipe 14, and a relatively smaller diameter at a lower end 64*b*, which fits snugly around the lower end 60*b* of the shaft 60*a*. Strainer 64 has a plurality of holes 64*c*, which strain water that flows into the open upper end 64*a* and out through the holes 64*c*, catching hair, debris and objects inside the strainer 64. An O-ring seal or a gasket can be placed around the perimeter of the disc 62 for sealing against the inside wall of the drain pipe 14. The disc 62 serves as a centralizer at the lower end of the drain flange cover 60, and the upper end 64*a* of the strainer basket 64 serves as a centralizer for the upper portion of the drain flange cover 60.

Figure 5B:
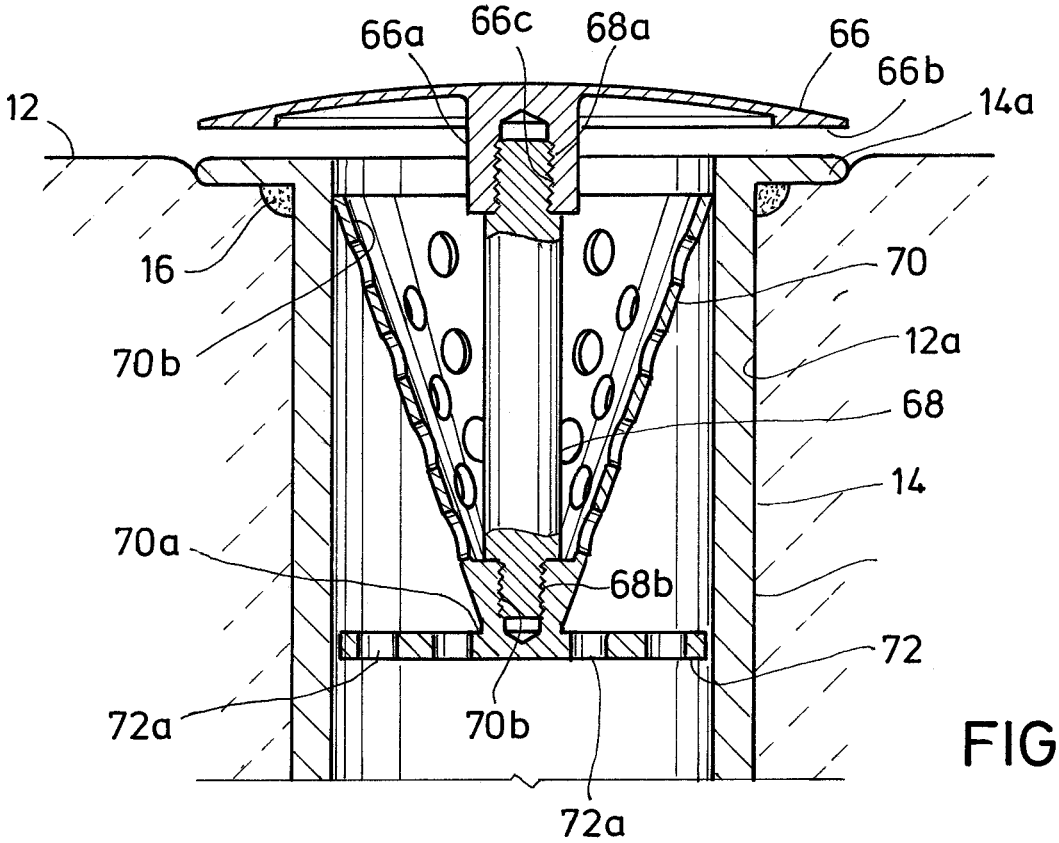
FIG. 5B is a side elevation in cross-section of a drain flange cover having a longitudinal shaft, a disk on the lower end of the shaft and a strainer basket surrounding the shaft, according to the present invention.

With reference to FIGS. 5A and 5B, the central, longitudinal shaft 60*a* in FIG. 5A is fixed to or formed integral with the drain flange cover 60 and the disc 62. A drain flange cover 66 is very similar to the one if FIG. 5A, except a central, longitudinal shaft 68 has a male-threaded upper end 68*a*, and the drain flange cover 66 has a central tubular projection 66*a* on its lower side 66*b* with female threads 66*c* for threaded engagement with the shaft 68. Shaft 68 has a male-threaded lower end 68*b*. A regular funnel-shaped strainer basket 70 has a lower end 70*a*, which has a bore with female threads 70*b*. Strainer 70 is threaded onto the lower end 68*b* of the shaft 68 and has a threaded engagement between the female threads 70*b* in the lower end 70*a* of the strainer 70 and the male threads 68*b* on the lower end of the shaft 68. A strainer disc 72 is either in a threaded engagement with the male threads 68*b* on the lower end of the shaft 68 or is otherwise fixed to the lower end 68*b* of the shaft 68. The strainer disc has a plurality of holes 72*a* and preferably fits snugly in the drain pipe 14. An upper end 70*b* of the strainer 70 has a larger diameter than the lower end 70*a* and fits snugly inside the drain pipe 14, thereby centralizing the drain flange cover 66 over and thereby covering and hiding the drain flange 14*a*.

Figure 5C:
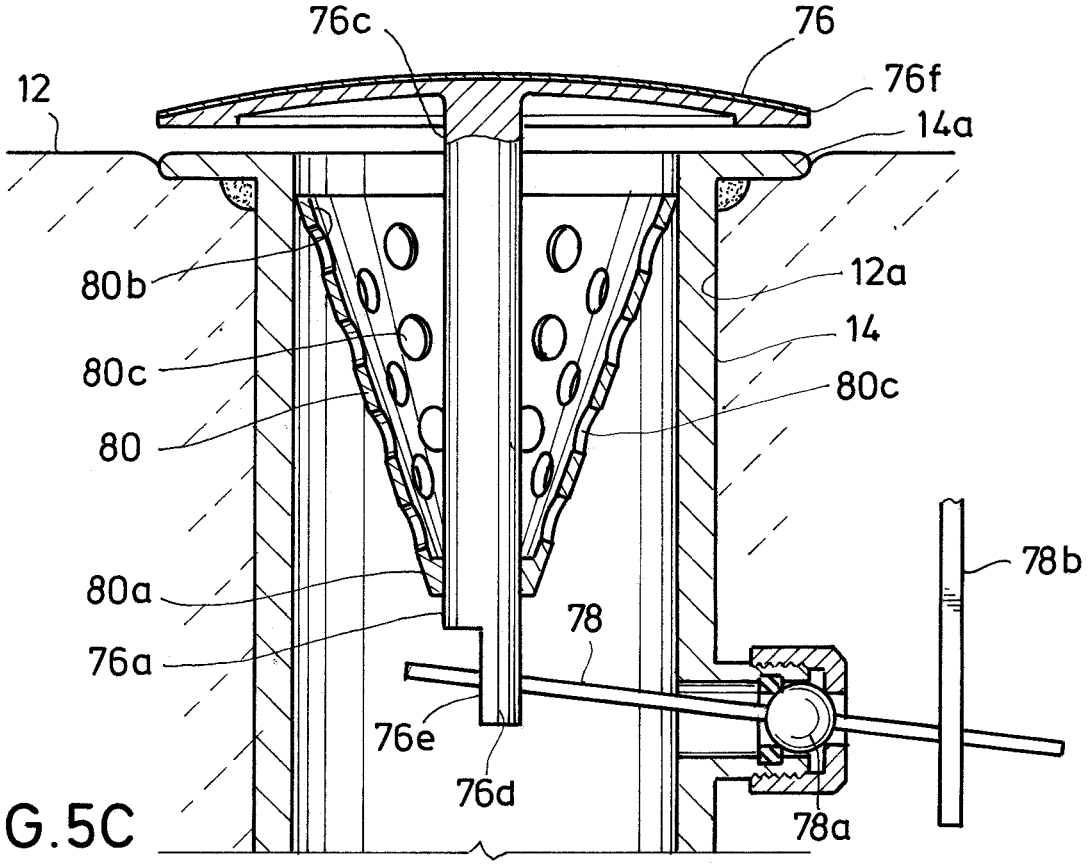
FIG. 5C is a side elevation in cross-section of a drain flange cover having a longitudinal shaft, a pivot rod holder on the lower end of the shaft and a strainer basket surrounding the shaft, according to the present invention.

FIG. 5C is a side elevation in cross-section of a drain flange cover 76 in the sink or bathtub 12, which has the drain opening 12*a* and the drain pipe 14 and drain flange 14*a*. A solid, central, longitudinal shaft 76*a* projects perpendicularly from the underside of the drain flange cover 76. An upper end 76*c* of shaft 76*a* is fixed to the underside of the drain flange cover 76, and a lower end 76*d* of shaft 76*a* has a means 76*e* for receiving a pivot rod 78. Pivot rod 78 can be received in the drain pipe 14 as described above. A strainer basket 80 surrounds the shaft 76*a* and has a lower end 80*a* that fits snugly around or is secured to the shaft 76*a*. Strainer basket 80 has the shape of a regular funnel with a large diameter at an upper end 80*b*, which fits snugly inside the drain pipe 14, and a relatively smaller diameter at the lower end 80*a*. Strainer 80 has a plurality of holes 80*c*, which strain water that flows into the open upper end 80*b* and out through the holes 80*c*, catching hair, debris and objects inside the strainer 80. The pivot rod 78 can be pivoted about a pivot ball 78*a* by lifting up and pushing down on a control rod 78*b*, thereby closing or opening the drain flange cover 76. Water can be retained in the sink or bathtub 12 while the drain flange cover 76 is closed against the drain flange 14*a*, provided a suitable seal or gasket is included in the drain stopper device. Alternatively, standoffs can be included between the drain flange cover 76 and the drain flange 14*a* for maintaining the drain flange cover 76 in an open position. If the means 76*e* for receiving the pivot rod 78 allows the shaft 76*a* to be easily disengaged from the pivot rod 78, then the drain flange cover 76 can be pulled out of the drain pipe 14 for cleaning out hair, debris and objects from inside the strainer 80. One such means 76*e* is a two-prong fork that engages the pivot rod 78 in a friction fit.

Figure 5D:
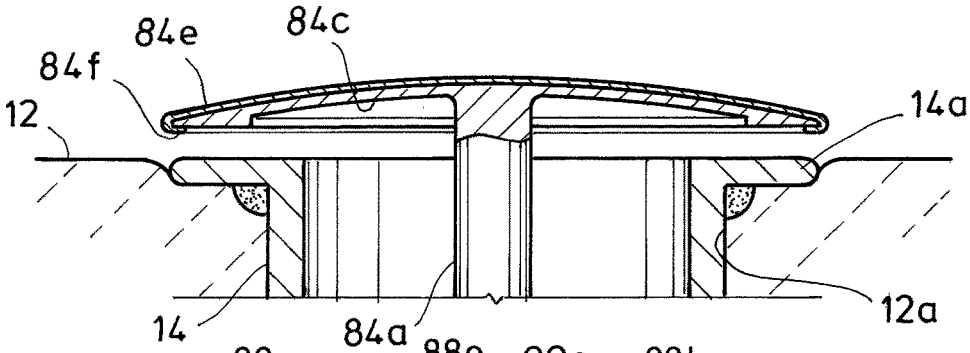
FIG. 5D is a side elevation in cross-section of a drain flange cover having a longitudinal shaft, according to the present invention.

With reference to FIGS. 5C and 5D, a decorative sheet of material 76*f* is shown attached to an upper surface of the drain flange cover 76 in FIG. 5C. The means for attachment of the decorative sheet 76*f* to the upper surface of the drain flange cover 76 include adhesion, suction and magnetic attraction. FIG. 5D is a side elevation in cross-section of a drain flange cover 84 in the sink or bathtub 12, which has the drain opening 12*a* and the drain pipe 14 and drain flange 14*a*. A solid, central, longitudinal shaft 84*a* projects perpendicularly from the underside of the drain flange cover 84. An upper end 84*b* of shaft 84*a* is fixed to the underside of the drain flange cover 84. A dome-shaped substructure 84*c* has a size and a shape typical of a cap on a drain stopper. The dome-shaped substructure 84*c* has a curved upper side that comprises the dome shape and an opposing underside. The dome-shaped substructure 84*c* has an upper surface 84*d* that has a curvature of a dome and has a diameter of typically between one and three or four inches for covering and hiding the drain flange 14*a*. A decorative sheet of material 84*e* has a diameter greater than the diameter of the dome-shaped substructure 84*c* and has a perimeter 84*f* that is wrapped under the perimeter of the dome-shaped substructure 84*c*. The decorative sheet of material 84*e* is crimped at its perimeter 84*f* for fastening the sheet of material 84*e* to the dome-shaped substructure 84*c* of the drain flange cover 84. The sheets of material 76*f* and 84*e* can be made of or can have a finish such as chrome, polished chrome, brushed chrome, bronze, oil-rubbed bronze, polished bronze, brushed nickel, polished nickel, polished brass, satin brass, satin bronze, copper, matte black and white. The dome-shaped substructure 84*c* can be made of a plastic or polymeric material.

Figure 6:
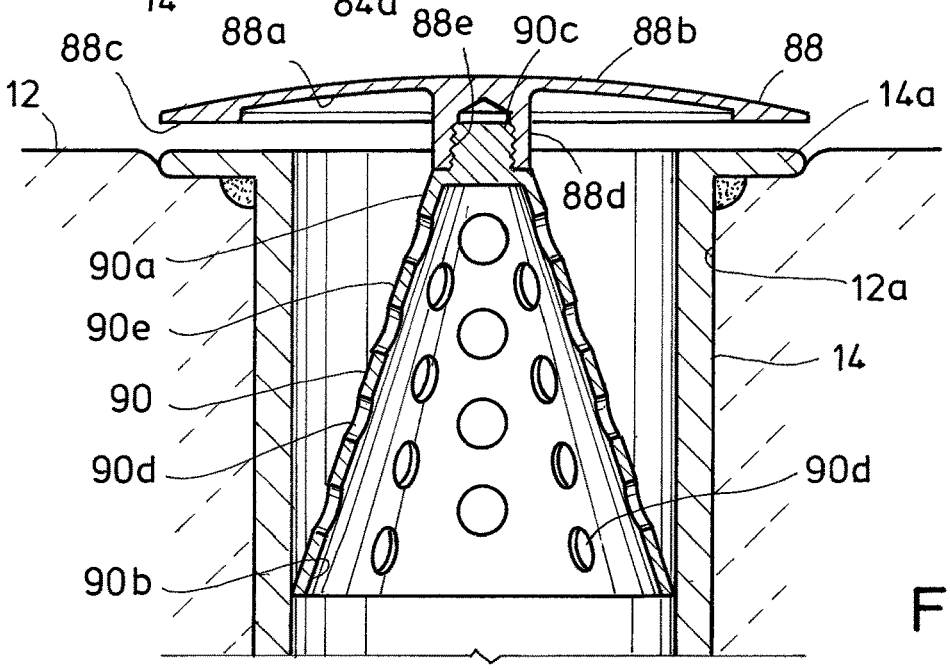
FIG. 6 is a side elevation in cross-section of a drain flange cover that has an inverted-funnel-shaped strainer basket, according to the present invention.

FIG. 6 is a side elevation in cross-section of a drain flange cover 88 in the sink or bathtub 12, which has the drain opening 12*a* and the drain pipe 14 and drain flange 14*a*. Drain flange cover 88 has a dome-shaped substructure 88*a*, which has a curved upper surface 88*b* that comprises the dome shape and an opposing underside 88*c*. Drain flange cover 88 preferably has a decorative sheet of material (not shown) such as described in FIGS. 5C and 5D that covers the upper surface 88*b*. A short tube 88*d* is attached to and projects perpendicularly from the underside 88*c* of the substructure 88*a*. The tube 88*d* is formed integrally with or is attached to the substructure 88*a* and has a bore with female threads 88*e*. A strainer 90 has an inverted funnel shape as opposed to the shape of a regular funnel. Strainer 90 has an upper end 90*a* and a lower end 90*b*. The diameter of the lower end 90*b* is greater than the diameter of the upper end 90*a*, which is what is meant by the inverted funnel shape. A regular funnel shape has a greater diameter at its upper end than at its lower end. An inverted funnel shape has a greater diameter at its lower end than at its upper end.

Strainer 90 has a stud 90*c* on its upper end 90*a*, which has male threads that matingly engage the female threads 88*e* in the tube 88*d*. The upper surface of the upper end 90*a* of the strainer 90 is shown as having a diameter equal to that of the outer diameter of the tube 88*d*, but could be slightly greater and could have perforations. The lower end 90*b* of the strainer 90 has an outside diameter that allows the strainer 90 to fit snugly inside the drain pipe 14 and may or may not have a seal such as a gasket or an O-ring that slides within the drain pipe 14. Strainer 90 has openings 90*d* through which water can drain, while hair, debris and objects are caught on an outer surface 90*e* of the strainer 90. Catching hair, debris and objects on the outer surface 90*e* may allow for easier cleaning of the strainer 90 than catching the same on an inner surface in a regular funnel. Although not shown, drain flange cover 88 may also have a set of standoffs that include centering legs such as described with reference to FIG. 4B for keeping the drain flange cover 88 centered over the drain pipe 14 so that it always covers the drain flange 14*a*. Drain flange cover 88 is shown with the dome-shaped substructure 88*a* being solid and impermeable. However, the drain flange cover 88 could be a strainer with holes or openings and could be flat rather than dome shaped. In either case, the drain flange cover would preferably include a decorative sheet or be made of a decorative material for providing a desired finish appearance. Although not shown, a central, longitudinal shaft such as the shaft 76*a* described with reference to FIG. 5C can be attached at an upper end to the upper end 90*a* of the strainer 90, and the lower end of the shaft can be engaged by a means for opening and closing such as a pivot rod. In this embodiment, the drain flange cover 88 would include means for sealing the drain flange cover 88 with the drain flange 14*a* so that water can be retained within the sink or bathtub 12.

FIG. 6 describes a drain flange cover comprising: a dome-shaped structure having an upper surface that has a curvature of a dome and an opposing lower surface, where the dome-shaped structure is sized and designed to cover and hide the drain flange; and a screen having an upper end attached to or formed integral with the lower surface and an opposing lower end, where the screen has a longitudinal axis that is generally perpendicular to the lower surface of the dome-shaped structure, where the lower end of the screen has a diameter that is approximately equal to the diameter of the drain opening, where the upper end has a diameter that is substantially smaller than the diameter of the lower end, where the screen has openings through which water can pass and structural elements that define the openings, and where hair and debris in the water tends to be caught by the structural elements. The screen has the shape of a cone, preferably a frustoconical shape. The screen is preferably shaped and positioned as an inverted funnel. The screen may be a wire mesh, a plastic mesh or a perforated sheet of material. The drain flange cover preferably includes a disc attached to or formed integral with the lower end of the screen. The disc may be a wire mesh, a plastic mesh or a perforated sheet of material. A ring may be attached to or formed integral with the lower end of the screen. The disc or the ring is preferably sized and designed to fit tightly within drain pipe 14. A seal may be included around the perimeter of the disc or ring.

Figure 7:
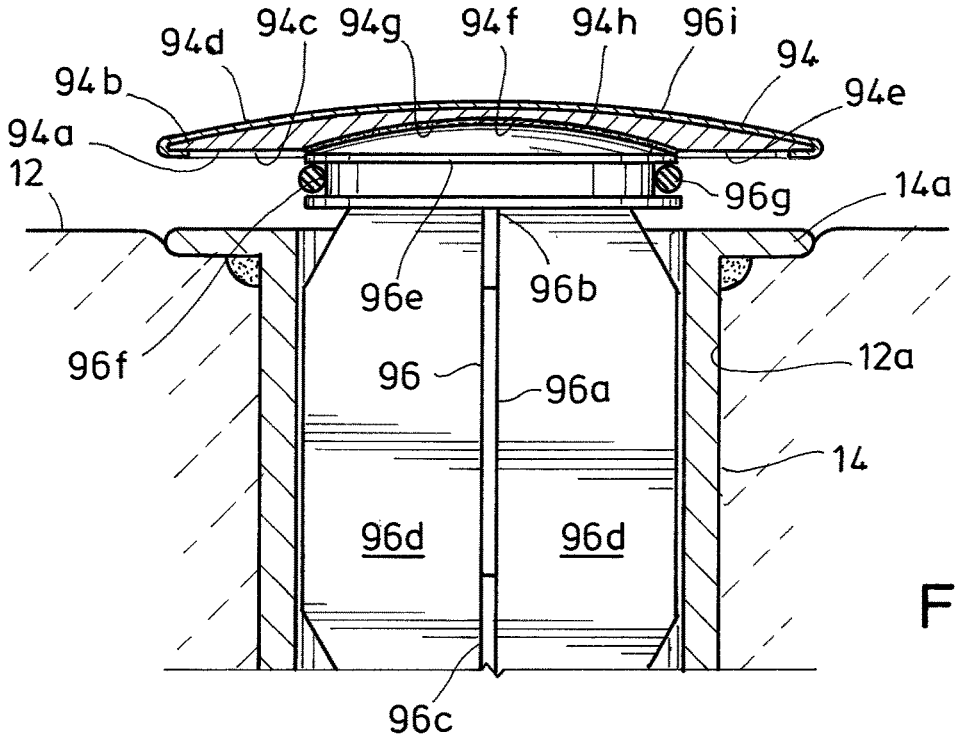
FIG. 7 is a side elevation in cross-section of a drain flange cover attached to the cap of a drain stopper, according to the present invention.

FIG. 7 is a side elevation in cross-section of a drain flange cover 94 in the sink or bathtub 12, which has the drain opening 12*a* and the drain pipe 14 and drain flange 14*a*. Drain flange cover 94 has a dome-shaped substructure 94*a*, which has a curved upper surface 94*b* that comprises the dome shape and an opposing underside 94*c*. Drain flange cover 94 includes a decorative sheet of material 94*d* such as described in FIGS. 5C and 5D that covers the upper surface 94*b*. The underside 94*c* of the drain flange cover 94 has a generally flat and straight portion 94*e* adjacent to the perimeter of the drain flange cover 94 and a recess 94*f* in a central portion that is surrounded by the flat, straight portion 94*e*. The recess 94*f* is defined by a smooth, curved surface 94*g* that has a curvature and shape similar to or nearly identical to the curved upper surface 94*d* that provides the dome shape for the dome-shaped substructure 94*a*. A drain stopper 96 is received inside the drain pipe 14. Drain stoppers are described in the U.S. Patent Application Pub. Nos. 2017/0260724 A1, 2017/0314244 A1 and 2017/0314245 A1 noted above. Drain stopper 96 has a central longitudinal shaft 96*a*, an upper end 96*b*, a lower end 96*c*, and centralizing fins 96*d*. A cap 96*e* is attached to the upper end 96*b* of the shaft 96*a*. Cap 96*e* has a recessed portion 96*f* in which an O-ring 96*g* is received. Cap 96*e* has a dome-shaped upper and outer surface 96*h* that has about the same shape as the curved surface 94*g* and is sized and shaped to be matingly received in the recess 94*f*. Drain flange cover 94 is fastened to the cap 96*e* by a means 96*i*, and the dome-shaped upper and outer surface 96*h* of the cap 96*e* fits in the recess 94*f* of the drain flange cover 94. The dome-shaped upper and outer surface 96*h* of the cap 96*e* fits matingly along the smooth, curved surface 94*g* that defines the recess 94*f*. The means 96*i* for fastening the drain flange cover 94 to the drain stopper 96 may be a layer of adhesive, a layer of glue with a peel-and-stick film that can be removed, a magnetic attraction and suction. Thus, a dome-shaped drain flange cover has a convex upper surface that has a curvature of a dome and an opposing concave lower surface, which is sized and designed to mate with a convex upper surface of a cap on a drain stopper. A magnet or glue in or on the concave lower surface fastens the dome-shaped structure to the cap on the drain stopper. Suction can be used instead of magnetic attraction and adhesion to fasten the drain flange cover to the cap on the drain stopper.

FIG. 7 describes a drain flange cover for covering a drain flange around a drain opening in a sink or bathtub that has a drain stopper in the drain opening, where the drain stopper has a cap that has a convex upper surface. The drain flange cover comprises: a dome-shaped structure that has a convex upper surface that has a curvature of a dome and an opposing concave lower surface that is sized and designed to mate with the convex upper surface of the cap on the drain stopper; and a magnet or glue in or on the concave lower surface for fastening the dome-shaped structure to the cap on the drain stopper. The dome-shaped structure preferably has a diameter of between one and three inches and is sized to cover and hide the drain flange. The diameter of the drain flange cover is typically about two inches for a sink and about two and a half inches for a bathtub drain flange. A sheet of a decorative material preferably covers the convex upper surface of the dome-shaped structure. The sheet of a material can be glued on or can lap under the dome-shaped structure. The sheet is preferably laps under and is crimped under the dome-shaped structure for fastening the sheet of material to the dome-shaped structure.

Figure 8A:
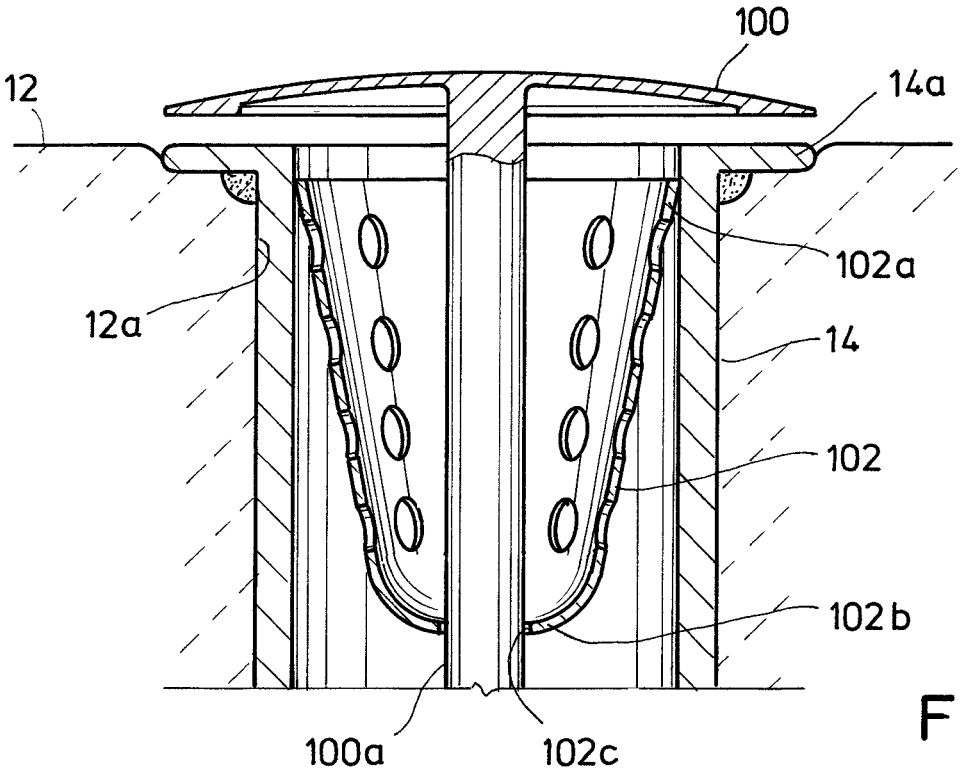
FIG. 8A is a side elevation in cross-section of a drain flange cover having a longitudinal shaft and a strainer basket surrounding the shaft, according to the present invention.

FIG. 8A is a side elevation in cross-section of a drain flange cover 100 in the sink or bathtub 12, which has the drain opening 12*a* and the drain pipe 14 and drain flange 14*a*. A solid, central, longitudinal shaft 100*a* projects perpendicularly from the underside of the drain flange cover 100. A strainer basket 102 having a U-shaped longitudinal cross-section has an open upper end 102*a* and a lower end 102*b*. The lower end 102*b* has a smaller diameter than the upper end 102*a*. The lower end 102*b* has an opening 102*c*, which is sized so that the lower end 102*b* fits snugly around the shaft 100*a*. The upper end 102*a* is sized to fit snugly inside the drain pipe 14. Standoffs with centering legs can be used to center the drain flange cover 100 in the drain opening, or transverse structural elements can extend between the shaft 100*a* and the strainer 102 for centering the shaft inside the strainer, thereby centering the drain flange cover 100 over the drain opening 12*a* to ensure the drain flange cover 100 hides the drain flange 14*a*.

Figure 8B:
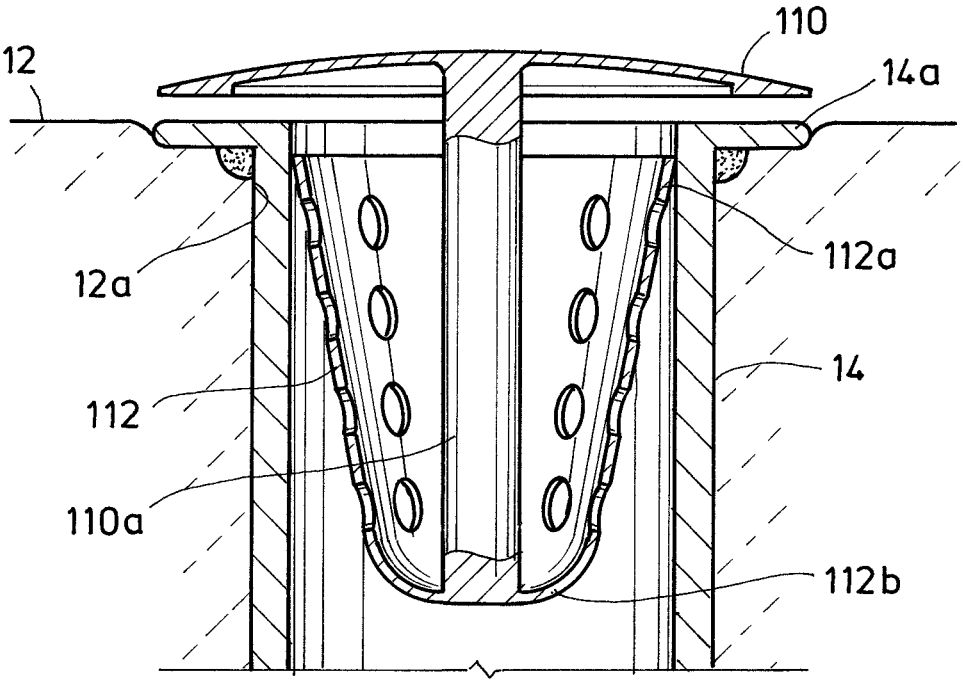
FIG. 8B is a side elevation in cross-section of a drain flange cover having a longitudinal shaft and a strainer basket surrounding the shaft, according to the present invention.

FIG. 8B is a side elevation in cross-section of a drain flange cover 110 in the sink or bathtub 12, which has the drain opening 12*a* and the drain pipe 14 and drain flange 14*a*. A solid, central, longitudinal shaft 110*a* projects perpendicularly from the underside of the drain flange cover 110. A strainer basket 112 having a U-shaped longitudinal cross-section has an open upper end 112*a* and a lower end 112*b*. The lower end 112*b* has a smaller diameter than the upper end 112*a*. The lower end 112*b* is fixed to the lower end of the shaft 110*a*. The upper end 112*a* is sized to fit snugly inside the drain pipe 14. Most aspects of the drain flange cover 100 in FIG. 8A also apply to the drain flange cover 110 in FIG. 8B.

FIGS. 8A and 8B describe a drain flange cover that comprises: a dome-shaped structure having an upper surface that has a curvature of a dome and an opposing lower surface, wherein the dome-shaped structure is sized and designed to cover and hide the drain flange; a shaft having an upper end attached to or formed integral with the dome-shaped structure and an opposing lower end, where the shaft projects perpendicular from the lower surface of the dome-shaped structure; and a strainer basket surrounding the shaft, where the strainer basket is fixed to the dome-shaped structure or to the shaft or is removably attached to the dome-shaped structure or to the shaft. The strainer basket is sized to fit snugly in the drain opening. Centering elements are preferably included to ensure that the drain flange cover hides the drain flange. A snug fit of the upper end of the strainer basket inside the drain pipe will function as a centralizer, particularly if the strainer basket is generally rigid.

Figure 9:
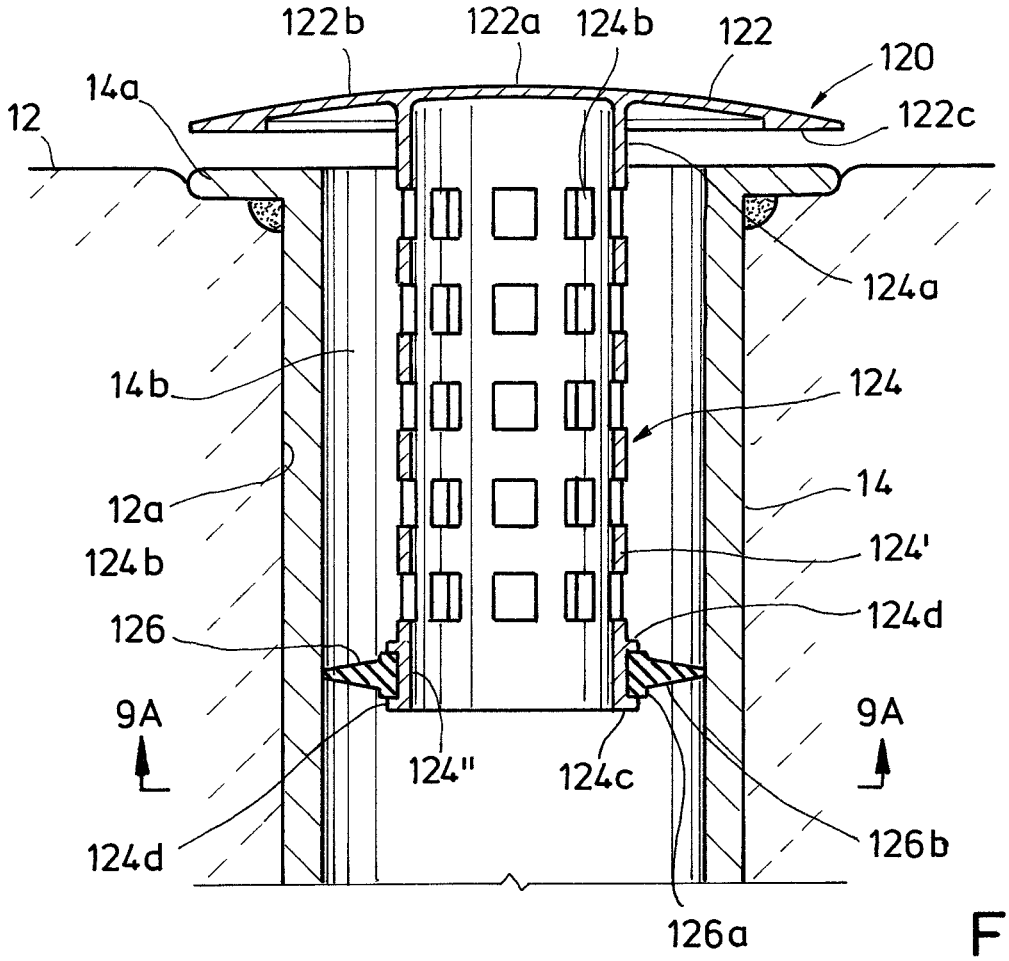
FIG. 9 is a side elevation in cross-section of a drain flange cover having a perforated tubular shaft as a strainer basket, according to the present invention.

FIG. 9 is a side elevation in cross-section of a drain flange cover and strainer 120 in the sink or bathtub 12, which has the drain opening 12*a* and the drain pipe 14 and drain flange 14*a*. The drain flange cover and strainer 120, which will be referred to as the cover/strainer 120, is similar to drain flange cover 40, which was described with reference to FIG. 3A. Much of the description of drain flange cover 40 applies to cover/strainer 120. Cover/strainer 120 includes a flange cover 122 in an upper portion, which has a dome-shaped structure 122*a* with an upper and outer surface 122*b* and a lower side that includes a washer-shaped lower surface 122*c*. A strainer 124 has a central, longitudinal, tubular, cylindrical strainer body 124' that has an upper end 124*a*, which is attached to or formed integral with the lower side of the flange cover 122. In this embodiment, strainer 124 is formed integral with the flange cover 122, and the washer-shaped lower portion with the lower surface 122*c* surrounds the strainer 124. Strainer 124 has holes or openings 124*b*, which are shown as having a square shape, which instead could be circular or oval or which could be a plurality of slits or slots. Strainer 124 can be described as a perforated tubular shaft that depends downwardly from the underside of the cap.

Strainer 124 has a lower end 124*c*, and a flange 124*d* surrounds the perimeter of the cylindrical lower portion of the strainer 124 adjacent to its lower end 124*c*. Flange 124*d* has upper and lower shoulders that project radially from the strainer body 124' with respect to the longitudinal axis of the strainer body 124', which are separated by a base portion. Flange 124*d* has a U-shaped cross-section, where the upper and lower shoulders are the base portion of the U-shape. A ring-shaped gasket 126 is received in the flange 124*d*. Gasket 126 has a base portion 126*a*, which in cross-section has a rectangular shape, and a wiper portion 126*b* that tapers thinner as it projects more radially. Gasket 126 is sized and designed to fit snugly inside the drain pipe 14. Gasket 126 can be sized and designed to fit sufficiently tightly inside the inside wall of the drain pipe 14 to hold the strainer body 124' and the flange cover 122 in a desired position. In the case of a tub drain, the cover/strainer might rest on a tub shoe typically found in a drain pipe connected to a bathtub. Centering flanges are not shown, but can be added to maintain the cover/strainer 120 in the center of the drain pipe 14. Spacers are not shown, but can be added to ensure there is a space between the lower surface 122*c* of the flange cover 122, so that water can drain out of a sink or bathtub into the drain pipe 14. Drain flange cover and strainer 120 can be modified to include elements similar to the standoffs 56 and the centering legs 56*a* shown in FIG. 4B. A combined spacer-centralizer element can be attached to the underside of the cap and/or to the tubular shaft for maintaining a space between the cap and the drain flange and for centering the strainer 124 in the drain pipe.

Figure 9A:
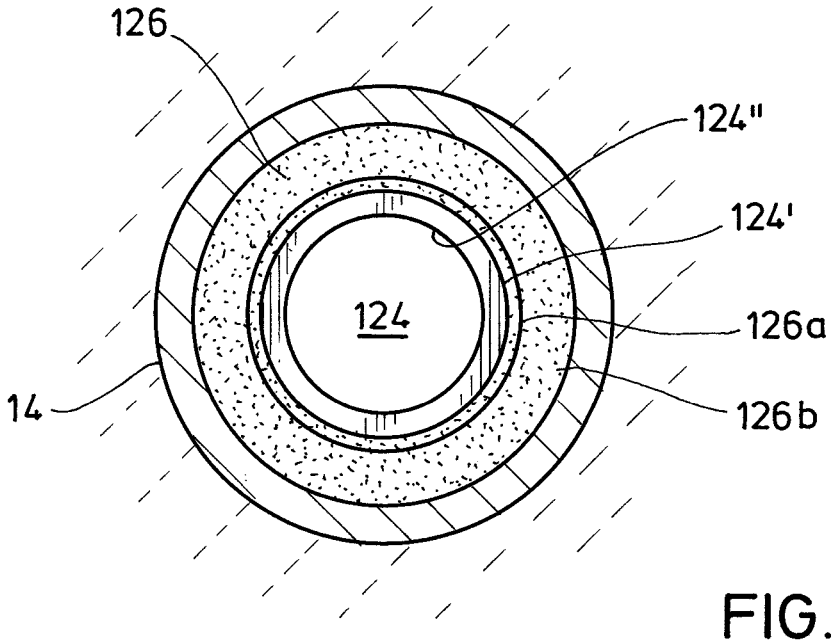
FIG. 9A is a cross-section of the drain flange cover of FIG. 9 as seen along the line 9A-9A.

Water drains under the flange cover 122 below its lower surface 122*c* and above the drain flange 14*a*. Flange cover 122 has a solid upper and outer surface 122*b* with no holes or openings, so water does not flow through flange cover 122. Consequently, the flange cover 122 has the appearance of a normal drain stopper, except for being wide enough to cover and hide the drain flange 14*a*. Gasket 126 provides a solid and sealed barrier so that water does not tend to drain through an annular space 14*b* between an outside surface of the strainer body 124' and an inside wall surface of the drain pipe 14. Water drains into the annular space 14*b* and through the holes or openings 124*b* and into a central drain space 124*e*, which is defined by an inside wall surface 124" of the tubular strainer body 124', as best seen in FIG. 9A. Hair, debris and objects that do not readily pass through the openings 124*b* tend to be caught and contained within the annular space 14*b*. Strands of hair of a sufficient length may tend to wrap around the strainer body 124'. The diameter of flange cover 122 can be related to the diameter of the gasket, which is approximately the inside diameter of the drain pipe. The inside diameter of drain pipe from sinks and bathtubs is often 1.25 or 1.50 inches. The drain flange may extend radially from about 0.25 to about 0.50 inches beyond the inside diameter, so the diameter of the drain flange may approximately range from [(1.25+0.25+0.25)=1.75] to [(1.50+0.50+0.50)=2.50] inches. The drain flange cover should have a diameter at least as great as the diameter of the drain flange, preferably slightly greater. The diameter of the drain flange cover may typically range from 1.75 inches to 2.50, 2.75 or 3.00 inches, depending on the size of the drain flange to be covered. The diameter of the drain flange cover may be typically at least 0.50 to 1.00 inch greater than the diameter of the gasket, assuming the diameter of the gasket is the same as the inside diameter of the drain pipe and that the drain flange extends 0.25 to 0.50 inch beyond the inside diameter, in order for the drain flange cover to cover and hide the drain flange. The diameter of the drain flange cover for a drain flange in a bathroom sink is preferably about 2.5 inches.

FIG. 10 is a side elevation in cross-section of a drain flange cover and strainer 130 in the sink or bathtub 12, which has the drain opening 12*a* and the drain pipe 14 and drain flange 14*a*. Cover/strainer 130 includes a flange cover 132 in an upper portion, which has a dome-shaped structure 132*a* with an upper and outer surface 132*b* and a lower side that includes a washer-shaped lower surface 132*c*. A strainer 134 has a central, longitudinal, tubular, cylindrical strainer body 134' that has an upper end 134*a*, which is attached to the lower side of the flange cover 132 using a threaded connection. In this embodiment, the flange cover 132 has a short tube 132*d* projecting from its lower side, which has threads inside the tube. Strainer 134 has threads on the outside of its tubular shape adjacent to its upper end 134*a*, which thread into the threads in the short tube 132*d*, thereby fastening the strainer 134 to the flange cover 132. This threading arrangement can be reversed, and a connection other than threading can be used, such as press fit, snap fit, interlock fit, formed integral together or a glued fitting. Strainer 134 has a plurality of holes or openings 134*b*.

Strainer 134 has a lower end 134*c*, and a flange 134*d* surrounds the perimeter of the cylindrical lower portion of the strainer 134 adjacent to its lower end 134*c*. Flange 134*d* has upper and lower shoulders that project radially from the strainer body 134' with respect to the longitudinal axis of the strainer body 124', which are separated by a base portion. Flange 134*d* has a U-shaped cross-section, where the upper and lower shoulders are the base portion of the U-shape. A ring-shaped gasket 136 is received in the flange 134*d*. Gasket 136 has a base portion 136*a*, which in cross-section has a rectangular shape, and a wiper portion 136*b* that tapers thinner as it projects more radially. Gasket 136 is sized and designed to fit snugly inside the drain pipe 14. Gasket 136 can be sized and designed to fit sufficiently tightly inside the inside wall of the drain pipe 14 to hold the strainer body 134' and the flange cover 132 in a desired position.

Water drains under the flange cover 132 below its lower surface 132*c* and above the drain flange 14*a*. Flange cover 132 has a solid upper and outer surface 132*b* with no holes or openings, so water does not flow through flange cover 132. Consequently, the flange cover 132 has the appearance of a normal drain stopper, except for being wide enough to cover and hide the drain flange 14*a*. Gasket 136 does not provide a solid and sealed barrier so that water does tend to drain through the annular space 14*b* between the outside surface of the strainer body 134' and the inside wall surface of the drain pipe 14. Water drains into the annular space 14*b* and through the holes or openings 134*b* and into a central drain space 134*e*, which is defined by an inside wall surface 134" of the tubular strainer body 134'.

Figure 10B:
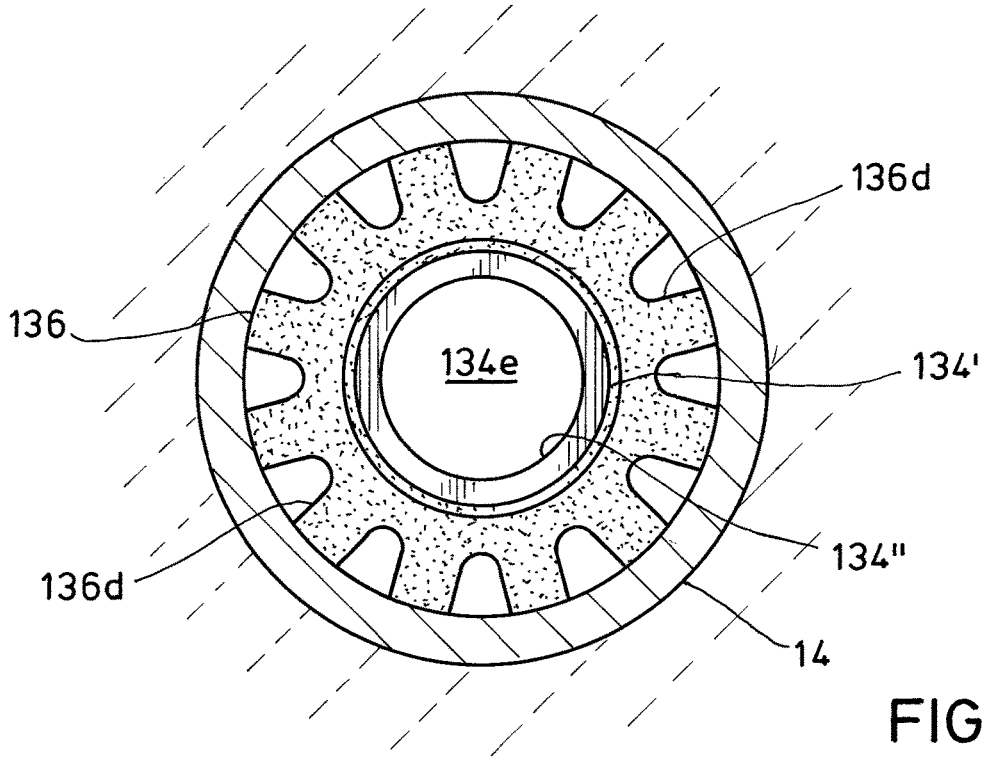
FIG. 10B is a cross-section of the drain flange cover of FIG. 10 as seen along the line 10B-10B.

FIG. 10A is a plan view of the underside of drain flange cover and strainer 130. Gasket 136 is shown in FIG. 10A as having openings 136*c* through which water can pass for draining the sink or bathtub. FIG. 10B is a plan view of the underside of drain flange cover and strainer 130. Gasket 136 is shown in FIG. 10B as having notches 136*d* along its perimeter, which prevents the gasket from having a tight seal against the inside wall of the drain pipe 14. Consequently, water can pass between the inside wall of the drain pipe 14 and the outer perimeter of the gasket 136 at the notches 136*d*. Hair, debris and objects that do not readily pass through the openings 134*b* in the strainer body 134' or through the openings or notches 136*c* or 136*d*, respectively, in the gasket 136 tend to be caught and contained within the annular space 14*b*.

Figure 11:
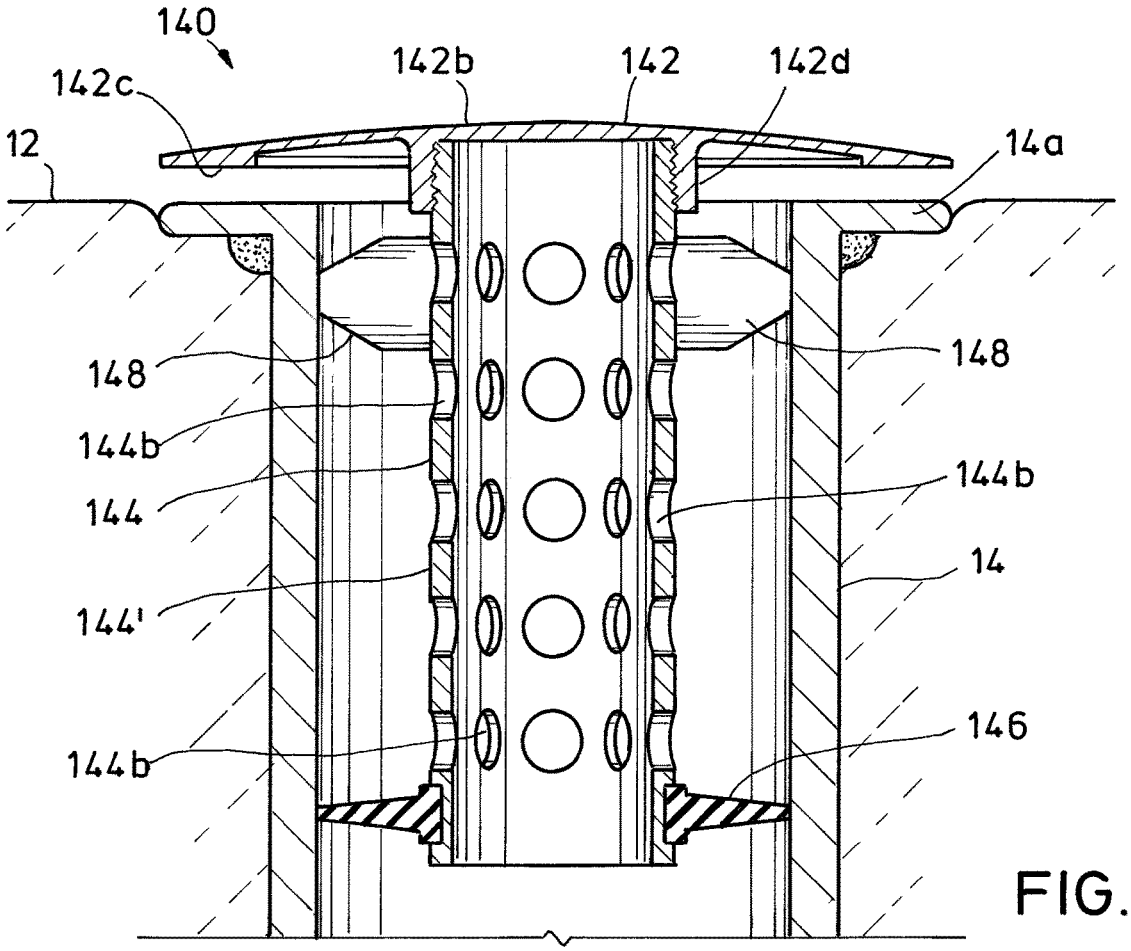
FIG. 11 is a side elevation in cross-section of a drain flange cover having a perforated tubular shaft as a strainer basket, according to the present invention.

FIG. 11 is a side elevation in cross-section of a drain flange cover and strainer 140 in the sink or bathtub 12, which has the drain opening 12*a* and the drain pipe 14 and drain flange 14*a*. Cover/strainer 140 includes a flange cover 142 in an upper portion, which has a dome-shaped structure 142*a* with an upper and outer surface 142*b* and a lower side that includes a washer-shaped lower surface 142*c*. A strainer 144 has a central, longitudinal, tubular, cylindrical strainer body 144' that has an upper end 144*a*, which is attached to the lower side of the flange cover 142 using a threaded connection as described for FIG. 10. Strainer 144 has holes or openings 144*b*, and a solid gasket 146 seals the strainer body 144' inside the drain pipe 144. Flange cover 142 has a short tube 142*d* projecting from its lower side, which has threads inside the tube. Strainer 144 has threads on the outside of its tubular shape adjacent to its upper end 144*a*, which thread into the threads in the short tube 142*d* for fastening the strainer 144 to the flange cover 142. Strainer 144 has holes or openings 144*b*.

Drain flange cover and strainer 140 includes centralizing fins 148. The centralizing fins 148 can be attached to either the flange cover 142, such as to the short tube 142*d*, or to the strainer body 144. Centralizing fins 148 extend radially outwardly from the longitudinal axis of the cover/strainer 140 to a point adjacent to the inside wall of the drain pipe 14 and tend to keep the cover/strainer 140 centered in the drain pipe 14 with the flange cover 142 fully hiding and covering the entire drain flange 14*a*. The centralizing fins can be modified to also serve as standoffs to space the flange cover 142 apart from the drain flange 14*a* and can instead be located on the tube 142*d* that projects downwardly from the underside of the drain flange cover 142.

The drain flange covers and the drain flange cover and strainers of the present invention are typically made to have a rigid structure and can be made of materials such as metal, acrylonitrile butadiene styrene (ABS) polymers, polystyrene, polyethylene and polypropylene to name a few of many possibilities. The flange covers and cover/strainers of the present invention would be unlikely to be made of highly flexible and highly resilient material such as silicones or polysiloxanes and rubbers such as styrene butadiene rubber, although the present invention is not limited to a particular material or even to being rigid.

Figure 12B:
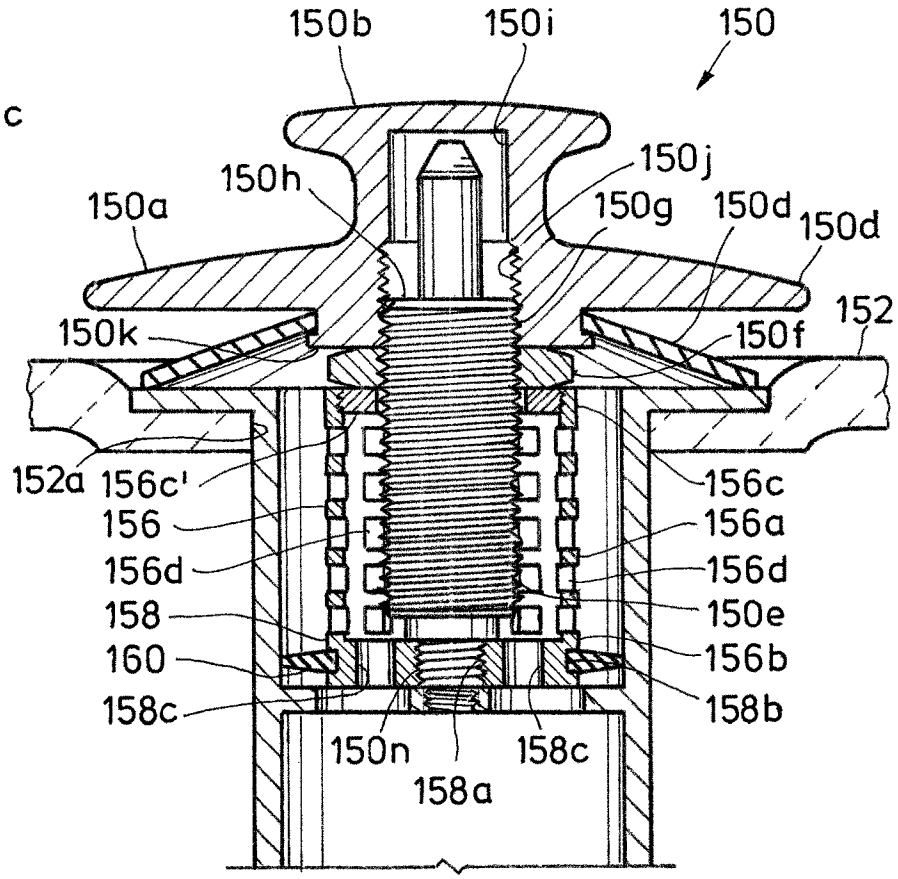
FIG. 12B is a side elevation in cross-section of a bathtub drain stopper and drain flange cover of FIG. 12A in its closed position.
Figure 12A:
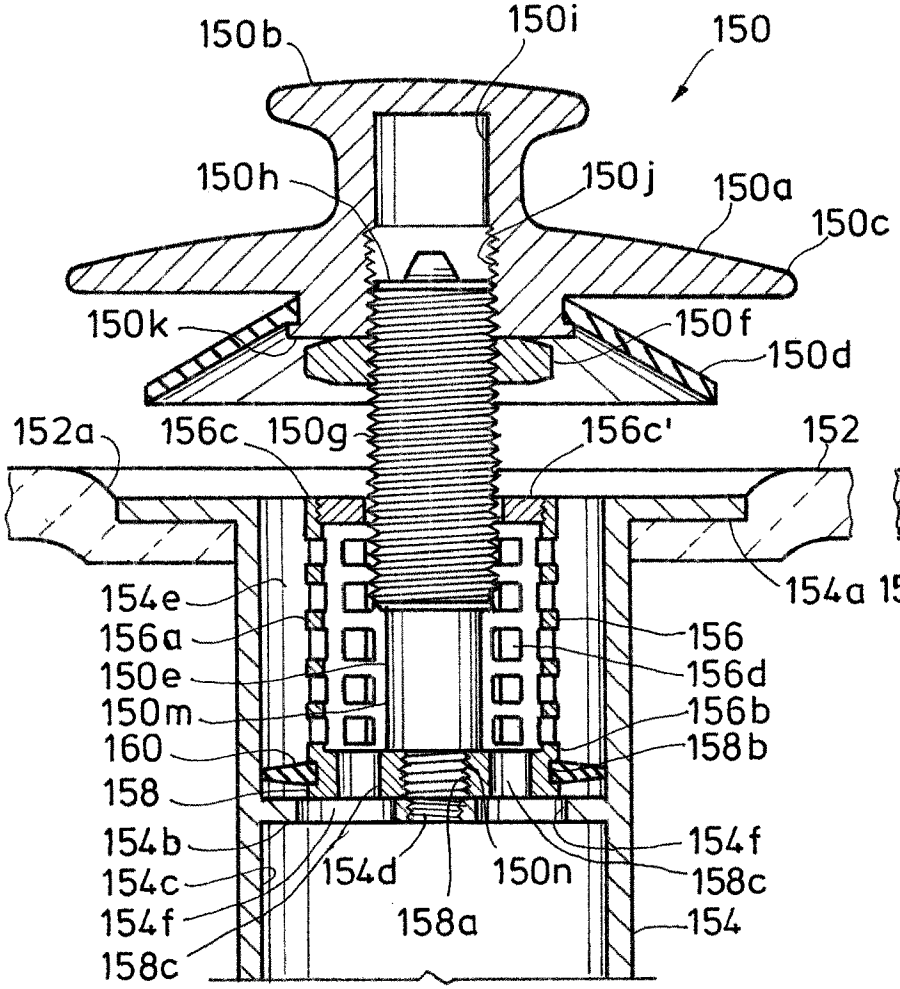
FIG. 12A is a side elevation in cross-section of a bathtub drain stopper and drain flange cover with a strainer basket, which is in its open position, according to the present invention.

FIGS. 12A and 12B are side elevations in cross-section of a drain stopper 150 for a bathtub 152, which has a drain opening 152*a* and a drain pipe 154 and a drain flange 154*a* sealed about the drain opening 152*a*. FIG. 12A shows drain stopper 150 in an open position, and FIG. 12B shows drain stopper 150 in a closed position. Drain pipe 154 may be referred to as a tub shoe, presumably because it generally has a 90-degree elbow close to the underside of the tub. Cross-bars 154*b* are attached to an inside wall 154*c* of the drain pipe 154. Alternatively, the drain pipe may include a fitting with female threads, and the drain flange is part of a cup-shaped fitting with male threads that thread into the female threads and has the cross-bars in the bottom of the cup-shaped fitting. Cross-bars 154*b* have a central threaded opening 154*d*. Drain stopper 150 includes a cap 150*a*, which has a grip portion 150*b*, a large and decorative drain cover 150*c*, a seal 150*d*, which seals against the drain flange 154*a*, a push-push mechanism 150*e* and a lock nut 150*f*. The push-push mechanism 150*e* has male threads 150*g* on an upper end 150*h*. Cap 150*a* has a cylindrical bore 150*i* along a longitudinal axis, which has female threads 150*j*. The male threads 150*g* are threaded into the female threads 150*j* in the cap 150*a*, and extra space in the bore 150*i* allows for adjusting the length of the drain stopper 150*a*. After the length is adjusted a desired amount, the lock nut 150*f* is tightened against an underside 150*k* of the cap 150*a* to maintain the desired length.

The upper end 150*h* of the push-push mechanism 150*e* comprises an upper tube, and a lower end comprises a lower tube 150*m*, which is received inside the upper tube in a sliding engagement. A stud 150*n* projects downwardly from the lower tube 150*m* and has male threads. Although not shown in the drawings, stud 150*n* has a central longitudinal bore defined by female threads, and an adapter can be used to engage or fasten the push-push mechanism 150*e* to the cross-bars 154*b*. The thread arrangements can be reversed throughout the drain stopper 150, and connections can be made that do not rely on a threaded engagement, such as by a press fit or by being made integral.

A strainer 156 has a central, longitudinal, tubular, cylindrical strainer body 156*a*. Strainer 156 has a lower end 156*b*, an upper end 156*c* and slits, slots, holes or openings 156*d* in the body 156*a*. The upper end 156*c* can be left open, but is shown as having a washer-shaped gasket 156*c*' in a threaded engagement with the strainer body 156*a*, which could instead be a press fit connection, a glued connection, an interlocking snap fit connection or a dovetail joint such as used in woodworking. Gasket 156*c*' does not fit tightly against the male threads 150*g* on the upper end 150*h* of the push-push mechanism 150*e*. A disk 158 is attached to or formed integral with the lower end 156*b* of the strainer 156. The disk 158 is oriented transverse to the longitudinal axis of the push-push mechanism 150*e*, similar to a flange that projects radially from the circumference of a pipe. Disk 158 has a central bore 158*a* with female threads and is in threaded engagement with the stud 150*n* on the lower end of the push-push mechanism 150*e*. The thread arrangement can be reversed, and the connection can be other than by threaded engagement, such as a press fit or by adhesion. Disk 158 has an outer perimeter, and a circumferential groove 158*b* is formed in the outer perimeter. A gasket 160 is received in the groove 158*a* and provides a seal between the inside wall 154*c* of the drain pipe 154 and the disk 158. Gasket 160 has a base portion that fits in the groove 158*b* and tapers as it extends radially toward the inside surface 154*c* of the drain pipe 154. An O-ring may be suitable for use as the gasket 160. Disk 158 has a plurality of openings 158*c* extending between its upper and lower planar surfaces so that water can drain downwardly from inside the strainer 156. The disk 158 and the strainer 156 rest on the cross-bars 154*b* in the drain pipe 154. The cross-bars 154*b* define a plurality of openings 154*f* extending between its upper and lower planar surfaces so that water can drain downwardly from the strainer 156 through the openings 158*c* in the disk 158 and through the openings 154*f* in the cross-bars 154*b*. The strainer basket and its disk are shown as resting on the cross-bars, but alternatively, the disk 158 and the strainer 156 can be fastened to the cross-bars 154*b*, preferably by fastening the push-push mechanism 150*e* to the cross-bars 154*b*. This can be accomplished, for example, using an adapter that has male threads on each end of a short rod, where one end threads into the bore in the stud 150*n* and the other end threads into a bore in the cross-bars. This and other aspects of bathtub drain stoppers are explained more fully in the present inventors' related U.S. Patent Application Pub. No. 20170314245 A1, Application No. 15584032, which is incorporated by reference in its entirety for all purposes.

Push-push mechanism 150*e* can be a conventional push-push mechanism that comprises a hollow cylinder with a spring and ratchet mechanism inside, which holds the mechanism (and, consequently, the drain stopper 150) in two positions, namely an open position and a closed position. U.S. Pat. No. 3,428,295, issued to Downey et al., discloses a push-push drain stopper with a spring and ratchet mechanism and is incorporated by reference for all purposes. Thompson et al. disclose a push-push drain stopper that uses a cam track in their U.S. Pat. No. 4,007,500, which is incorporated by reference. FIG. 12B shows the push-push mechanism 150*e* in the closed position with the seal 150*d* pressed against the drain flange 154*a*. While in the open position of FIG. 12A, a downward push on the gripping portion 150*b* of the cap 150*a* pushes the lower tube 150*m* into the upper tube 150*h*, thereby moving the push-push mechanism 150*e* from a first, open position shown in FIG. 12A to a second, closed position shown in FIG. 12B, which presumably puts a spring inside the tubes in an energized state. A downward push on cap 150*a* while in the closed position shown in FIG. 12B moves a ratchet or cam mechanism or some similar device, and the spring inside the tubes pushes the upper and lower tubes apart to return the drain stopper to the open position of FIG. 12A. One pushes downwardly on the upper end 150*b* of the cap 150*a* to open and to close the drain stopper 150. Drain stopper 150 is push to open and push to close.

A bathtub can be filled with water while the drain stopper 150 is in the closed position of FIG. 12B, and a bath can be taken. After taking a bath, one can push on the upper end of the drain stopper to move it into its open position shown in FIG. 12A. The bath water typically includes hair. As the water drains from the bathtub, the water flows into an annular space 154*e* defined between the inside wall 154*c* of the drain pipe 154 and the outside surface of the strainer body 156*a*. The water then flows into the strainer basket 156 through openings 156*d* in the body 156*a* of the strainer 156. Hair and other debris and objects tend to be caught on the outside surface of the strainer body 156*a* in the annular space 154*e*. Water flows downwardly into drain pipe 154 through the openings 158*c* in the disk 158 and through the openings 154*f* in the cross-bars 154*b*. Since the drain stopper 150 rests on the cross-bars 154*b* in the drain pipe 154, the stopper 150, the strainer 156 and the disk 158 can be pulled as a combined assembly out of the drain pipe 154. Hair, debris and objects can be removed from outside the strainer body 156*a*, and the strainer can be re-inserted into the drain pipe 154 for re-use. If the washer-shaped gasket 156*c*' is not included in the assembly, some water and debris may flow into the inside of the strainer 156, but it is believed that strainer 156 will still be sufficiently effective in removing hair and debris and objects from the water. Some of the hair, debris and objects may be caught inside the strainer rather than more exclusively on the outside of the strainer. The embodiment shown in FIGS. 12A and 12B provides a fully functional push-push drain stopper with a strainer basket that can be easily removed from the drain for cleaning the strainer. Other strainers disclosed herein and disclosed in patent documents that are incorporated by reference can be used instead of strainer 156. In addition, the cap 150*a*, with its large and decorative drain cover 150*c*, covers and hides the drain flange 154*a*, which allows one to hide a drain flange that has become undesirable in its appearance, possibly due to wear or damage or due to a color that one desires to change. The diameter of the decorative drain cover 150*c* is at least equal to the outermost diameter of the drain flange 154*a*, preferably greater than the diameter of the drain flange. The outermost diameter of the decorative drain cover 150*c* may be 5-50% or 5-25% greater than the outermost diameter of the drain flange 154*a*.

It is possible to use a lift-and-lock mechanism or a lift-and-turn mechanism instead of the push-push mechanism 150*e* for opening and closing a drain stopper according to the present invention. These and any other open-and-close mechanism can be fitted with the strainer 156 and the disk 158. The drain stopper can rest on the cross-bars 154*b*, but if opening the drain stopper tends to pull the stopper out of the drain pipe 154 when not desired, then the gasket 160 on the perimeter of the disk 158 can be re-designed to provide sufficient friction to stay in place during routine opening of the drain stopper, and yet be pulled out for cleaning when desired. A drain stopper with a push-push mechanism, a lift-and-lock mechanism or a lift-and-turn mechanism can be fastened to the cross-bars 154*b*, such as by the methods disclosed in the 20170314245 application incorporated above.

Figures 13A, 13B, 13C, 13D:
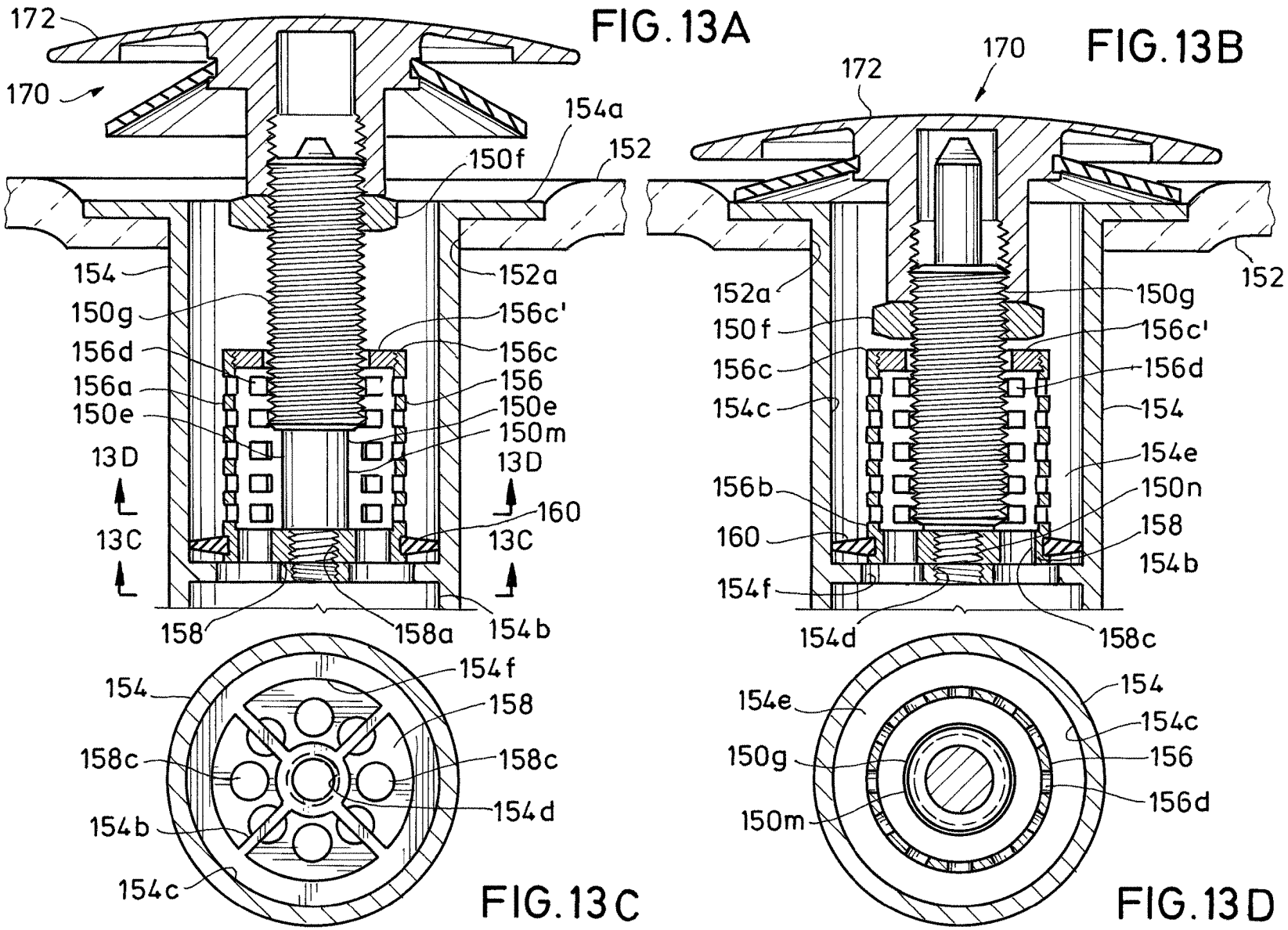
FIG. 13A is a side elevation in cross-section of a bathtub drain stopper and drain flange cover with a strainer basket, which is in its open position, according to the present invention.
FIG. 13B is a side elevation in cross-section of a bathtub drain stopper and drain flange cover of FIG. 13A in its closed position.
FIG. 13C is a cross-section of the bathtub drain stopper and drain flange cover of FIG. 13A as seen along the line 13C-13C.
FIG. 13D is a cross-section of the bathtub drain stopper and drain flange cover of FIG. 13A as seen along the line 13D-13D.

FIGS. 13A and 13B are side elevations in cross-section of a drain stopper 170 for the bathtub 152, which has the drain opening 152*a* and the drain pipe 154 and the drain flange 154*a* sealed about the drain opening 152*a*. FIG. 13A shows drain stopper 170 in an open position, and FIG. 13B shows drain stopper 170 in a closed position. The only significant difference between drain stopper 170 in FIGS. 13A and 13B and drain stopper 150 in FIGS. 12A and 12B is that drain stopper has a smooth, dome-shaped decorative cap 172. Other elements of drain stopper 170 are the same as for drain stopper 150, and the element numbers and explanations for drain stopper 150 are the same as for drain stopper 170.

FIG. 13C is a cross-section of drain stopper 170 as seen along the line 13C-13C in FIG. 13A. FIG. 13C is particularly helpful for seeing the cross-bars 154*b*, its central bore 154*d*, and its openings 154*f*. One can also see the underside of the disk 158 through the openings 154*f* in the cross-bars 154*b*. One can see the plurality of openings 158*c* in the disk 158 through the openings 154*f* in the cross-bars 154*b*. FIG. 13D is a cross-section of drain stopper 170 as seen along the line 13D-13D in FIG. 13A. One can see the strainer 156 and the push-push mechanism 150*e* in cross-section.

Drain stoppers 150 and 170 can also be used in a bathroom sink or basin. The present inventors' related U.S. Patent Application Pub. No. 20170314244 A1, Application No. 15584030, which is incorporated by reference in its entirety for all purposes, discloses a push-type drain stopper that can be used in a bathroom sink or basin that has a pop-up drain assembly with a pivot rod. The push-type drain stopper in the '4244 publication attaches to or rests on a rod that protrudes into the drain pipe through a pivot rod port. The disk 158 in drain stoppers 150 and 170 rests on the cross-bars 154*b*. With little or no modification, the disk 158 could instead rest on a rod protruding into a drain pipe for a bathroom sink or basin. FIG. 4 in the '4244 publication discloses a strainer that catches hair and debris inside a strainer basket. Drain stoppers 150 and 170 of the present invention use the strainer 156, which catches hair and debris on the outside of the strainer. Strainer 156 and disk 158 can be incorporated into the push-type drain stopper in the '4244 publication. One would then have a push-type drain assembly for a sink having a drain opening, comprising:

a drain pipe attached to the sink at the drain opening, wherein the drain pipe has a port and a stub surrounding the port, wherein the drain pipe has a longitudinal axis, and wherein the stub has a longitudinal axis that is transverse to the longitudinal axis of the drain pipe;

a rod passing through the port and protruding into the drain pipe, wherein the rod is fastened directly or indirectly to the stub, wherein the rod has a longitudinal axis that is transverse to the longitudinal axis of the drain pipe;

a push-type drain stopper received in the drain pipe and supported by the rod, wherein the drain stopper comprises a push-push mechanism that holds the drain stopper in one of two positions, wherein the two positions are an open position and a closed position, wherein the drain stopper has opposing upper and lower ends, wherein a push on the upper end of the drain stopper moves the drain stopper from the open position to the closed position and another push on the upper end of the drain stopper moves the drain stopper from the closed position back to the open position; and preferably a disk on the lower end of the drain stopper that rests on the rod, preferably wherein the disk has one or more openings, preferably further comprising a strainer basket around the push-push mechanism for catching hair, debris and objects on an outside surface of the strainer basket while water flows into the strainer basket and out through the one or more openings in the disk.

The drain assembly for a bathroom sink may be different from the drain pipe from a bathtub, but the drain stoppers 150 and 170 described for use in a bathtub can also be used retrofit a pop-up drain assembly in a bathroom sink that has a pivot rod protruding into a drain pipe through a pivot rod port. One can remove the drain stopper in the bathroom sink and replace it with drain stopper 150 or 170, thereby retrofitting the drain assembly to a push-to-open and push-to-close type of drain stopper, while continuing to use the existing drain pipe and pivot rod. A control rod that was previously used to move the stopper up and down would no longer be needed. Drain stopper 150 or 170 can be modified to include a two-prong fork on the lower end of the drain stopper for anchoring the drain stopper to a rod that protrudes into the drain pipe through a pivot rod port. The two-prong fork has a pair of parallel tines that are separated by a gap, and the rod is received in the gap in a tight fit with the tines. The two-prong fork is pressed transversely onto the rod. The diameter of the drain flange cover may typically range from 1.75 inches to 2.50, 2.75 or 3.00 inches, depending on the size of the drain flange to be covered. The diameter of the drain flange cover may be typically at least 0.50 to 1.00 inch greater than the diameter of the gasket, assuming the diameter of the gasket is the same as the inside diameter of the drain pipe and that the drain flange extends 0.25 to 0.50 inch beyond the inside diameter, in order for the drain flange cover to cover and hide the drain flange. The diameter of the drain flange cover for a drain flange in a bathroom sink is preferably about 2.5 inches.

Embodiments of the Invention

Various embodiments of the invention can be described as follows.

1. A drain flange cover for covering a drain flange surrounding a drain opening in a sink or bathtub, comprising:

a sheet of material having a circular shape, a diameter suitable for covering the drain flange, a central portion, a perimeter portion along the perimeter of the sheet of material that surrounds the central portion, a top side, a bottom side and a plurality of holes passing through the sheet of material from the top side to the bottom side that make the sheet suitable for use as a strainer; and a layer of glue on the bottom side of the sheet of material on the perimeter portion, wherein there is no glue on the top side of the sheet or on the bottom side within the central portion.

2. The drain flange cover of embodiment 1, wherein the diameter is between one and three inches.

3. The drain flange cover of embodiment 1 or 2, wherein the layer of glue has an annular shape, and wherein the article of manufacture does not have a central, longitudinal shaft extending transverse to the sheet of material.

4. A drain flange cover for covering a drain flange surrounding a drain opening in a sink or bathtub, comprising:

a sheet of material having a circular shape, a diameter suitable for covering the drain flange, a central portion, a perimeter portion along the perimeter of the sheet of material that surrounds the central portion, a top side, a bottom side and a plurality of holes passing through the sheet of material from the top side to the bottom side that make the sheet suitable for use as a strainer; and a magnet attached to the bottom side of the sheet of material on the perimeter portion, wherein the magnet has an annular shape, wherein there is no magnet on the top side of the sheet or on the bottom side within the central portion.

5. The drain flange cover of embodiment 4, wherein the diameter is between one and three inches.

6. The drain flange cover of embodiment 4 or 5, wherein the magnet has the shape of a washer.

7. The drain flange cover of embodiment 1 or 4, further comprising a dome-shaped substructure having a size and shape typical of a cap on a drain stopper, wherein the dome-shaped substructure has a curved upper side that comprises the dome shape and an opposing underside, and wherein the sheet of material covers the upper side.

8. The article of manufacture of embodiment 4, wherein there is no shaft connected to the underside of the substructure that projects from underside.

9. A drain flange cover for covering a drain flange around a drain opening in a sink or bathtub, comprising:

a dome-shaped structure having an upper surface that has a curvature of a dome and an opposing lower surface, wherein the dome-shaped structure has a diameter of between one and three inches and is sized to cover and hide the drain flange; and at least two standoffs that project from the lower surface of the dome-shaped structure that are designed and sized to rest on the drain flange and space the dome-shaped structure away from the drain flange so that water can flow out of the sink or bathtub between the lower surface of the dome-shaped structure and the drain flange around the stand-offs and into the drain opening.

10. The drain flange cover of embodiment 9, wherein the standoffs space the lower surface from the drain flange between 1/16 and 1/2 of an inch, and preferably wherein the standoffs include centering legs that extend away from the dome-shaped structure for centering the dome-shaped structure in the drain opening.

11. The drain flange cover of embodiment 9 or 10, further comprising glue or a magnet for each standoff for fastening the standoffs to the drain flange.

12. The drain flange cover of embodiment 9, 10 or 11, further comprising a sheet of material covering the upper surface of the dome-shaped structure.

13. The drain flange cover of embodiment 12, wherein the sheet of material is metallic and is bent to lap under the lower surface for fastening the sheet of material to the dome-shaped structure.

14. The drain flange cover of embodiment 12, wherein the sheet of material is metallic and is glued to the upper surface of the dome-shaped structure.

15. The drain flange cover of any one of embodiments 9-14, wherein there are four standoffs.

16. The drain flange cover of any one of embodiments 9-15, wherein the dome-shaped structure comprises a solid plastic article of manufacture.

17. The drain flange cover of any one of embodiments 9-15, wherein the dome-shaped structure comprises a plastic article of manufacture that is solid at the upper surface but has a web and hollow-cell structure at its lower surface.

18. The drain flange cover of any one of embodiments 9-15, wherein the dome-shaped structure comprises a web of material that defines a plurality of hollow cells.

19. A drain flange cover for covering a drain flange around a drain opening in a sink or bathtub that has a drain stopper in the drain opening, wherein the drain stopper has a cap that has a convex upper surface, the drain flange cover comprising:

a dome-shaped structure having a convex upper surface that has a curvature of a dome and an opposing concave lower surface that is sized and designed to mate with the convex upper surface of the cap on the drain stopper; and a magnet or glue in or on the concave lower surface for fastening the dome-shaped structure to the cap on the drain stopper.

20. The drain flange cover of embodiment 19, wherein the dome-shaped structure has a diameter of between one and three inches and is sized to cover and hide the drain flange.

21. The drain flange cover of embodiment 19 or 20, further comprising a sheet of a material covering the convex upper surface of the dome-shaped structure.

22. The drain flange cover of embodiment 21, wherein the sheet of a material laps under the dome-shaped structure.

23. The drain flange cover of embodiment 22, wherein the sheet of a material is crimped under the dome-shaped structure for fastening the sheet of material to the dome-shaped structure.

24. The drain flange cover of embodiment 22, wherein the sheet of a material is glued to the dome-shaped structure for fastening the sheet of material to the dome-shaped structure.

25. The article of manufacture or the drain flange cover of any one of embodiments 1-8, 12-14 or 21-24, wherein the sheet of material has a finish selected from the group consisting of polished chrome, brushed chrome, bronze, oil-rubbed bronze, polished bronze, brushed nickel, polished nickel, polished brass, satin brass, satin bronze, copper, matte black and white.

26. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange;

a shaft having an upper end attached to or formed integral with the dome-shaped structure and an opposing lower end, wherein the shaft projects perpendicular from the lower surface of the dome-shaped structure; and a disc attached to or formed integral with the lower end of the shaft, wherein the shaft projects perpendicular from the disc, and wherein the disc has a diameter that is slightly less than the diameter of the drain opening.

27. The drain flange of embodiment 26, further comprising a strainer basket surrounding the shaft between the dome-shaped structure and the disc.

28. The drain flange cover of embodiment 26 or 27, wherein the disc is circular, further comprising an O-ring around the circumference of the disc.

29. The drain flange cover of embodiment 26, 27 or 28, wherein the disc has an open structure that allows water to flow through the disc.

30. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange;

a shaft having an upper end attached to or formed integral with the dome-shaped structure and an opposing lower end, wherein the shaft projects perpendicular from the lower surface of the dome-shaped structure; and a strainer basket surrounding the shaft, wherein the strainer basket is fixed to the dome-shaped structure or the shaft or is removably attached to the dome-shaped structure or the shaft.

31. The drain flange cover of embodiment 30, wherein the strainer basket is sized to fit snugly in the drain opening.

32. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange;

a shaft having an upper end attached to or formed integral with the dome-shaped structure and an opposing lower end, wherein the shaft projects perpendicular from the lower surface of the dome-shaped structure; and a disc attached to or formed integral with the lower end of the shaft, wherein the shaft projects perpendicular from the disc, wherein the disc is circular and has a diameter that is slightly less than the diameter of the drain opening, and wherein the disc has openings through which water can pass and structural elements for screening hair and debris out of the water.

33. The drain flange cover of embodiment 32, further comprising an O-ring around the circumference of the disc.

34. The drain flange cover of embodiment 32, wherein the disc is sized and designed to seal against an inside wall of a pipe that defines the drain opening.

35. The drain flange cover of embodiment 32, 33 or 34, wherein the shaft is a tube having a perforated tube wall, wherein water can drain through the perforated tube wall, and wherein the perforated tube wall tends to screen hair and debris out of the water.

36. The drain flange cover of any one of embodiments 32-35, further comprising a sheet of a material covering the upper surface of the dome-shaped structure.

37. The drain flange cover of embodiment 36, wherein the sheet of material has a finish selected from the group consisting of polished chrome, brushed chrome, bronze, oil-rubbed bronze, polished bronze, brushed nickel, polished nickel, polished brass, satin brass, satin bronze, copper, matte black and white.

38. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange; and a screen having an upper end attached to or formed integral with the lower surface and an opposing lower end, wherein the screen has a longitudinal axis that is generally perpendicular to the lower surface of the dome-shaped structure, wherein the lower end of the screen has a diameter that is approximately equal to the diameter of the drain opening, wherein the upper end has a diameter that is substantially smaller than the diameter of the lower end, wherein the screen has openings through which water can pass and structural elements that define the openings, and wherein hair and debris in the water tends to be caught by the structural elements.

39. The drain flange cover of embodiment 38, wherein the screen has the shape of a cone.

40. The drain flange cover of embodiment 38, wherein the screen has a frustoconical shape.

41. The drain flange cover of embodiment 38, 39 or 40, wherein the screen is a wire mesh or a plastic mesh.

42. The drain flange cover of embodiment 38, 39 or 40, wherein the screen is a perforated sheet of material.

43. The drain flange cover of any one of embodiments 38-42, further comprising a disc attached to or formed integral with the lower end of the screen.

44. The drain flange cover of embodiment 43, wherein the disc is a wire mesh, a plastic mesh or a perforated sheet of material.

45. The drain flange cover of any one of embodiments 38-42, further comprising a ring attached to or formed integral with the lower end of the screen.

46. The drain flange cover of embodiment 43, 44 or 45, wherein the disc or the ring is sized and designed to fit tightly within an inside wall of a pipe that defines the drain opening.

47. The drain flange cover of embodiment 46, further comprising a seal around the perimeter of the disc or ring.

48. A drain flange cover and strainer for covering a drain flange around a drain opening in a sink or bathtub and for straining hair, debris and objects out of drain water, comprising:

a cap;

a tubular shaft having an upper end attached to or formed integral with the cap and an opposing lower end, wherein the tubular shaft projects perpendicular from the cap, and wherein the tubular shaft has openings sized and designed to filter out hair, debris and objects while allowing water to pass through the openings;

a gasket holder attached to or formed integral with the lower end of the shaft; and a gasket engaged with the gasket holder, wherein the gasket projects radially with respect to the longitudinal axis of the tubular shaft, and wherein the gasket is sized and designed to seal against an inside wall of a drain pipe.

49. The drain flange cover and strainer of embodiment 48, wherein the cap comprises a dome-shaped structure having an upper surface that has a curvature of a dome and an opposing lower surface, wherein the dome-shaped structure is sized and designed to cover and hide the drain flange.

50. The drain flange cover and strainer of embodiment 48 or 49, wherein the cap and the gasket each have a diameter, and wherein the diameter of the cap is greater than the diameter of the gasket, preferably wherein the diameter of the cap is at least 5, 10, 15 or 20% greater than the diameter of the gasket, more preferably wherein the diameter of the cap is at least 40% greater than the diameter of the gasket, and typically wherein the diameter of the cap is about 25% greater than the diameter of the gasket.

51. The drain flange cover and strainer of embodiment 48, 49 or 50, wherein the gasket holder is a flange that has a shape in cross-section similar to a wheel for holding an automobile tire.

52. The drain flange cover and strainer of any one of embodiments 48-51, wherein the cap comprises a dome-shaped structure having an upper surface that has a curvature of a dome and an opposing lower surface, and wherein the dome-shaped structure is sized and designed to cover and hide the drain flange, further comprising a sheet of a material covering the upper surface of the dome-shaped structure.

53. The drain flange cover and strainer of embodiment 52, wherein the gasket does not have holes or openings for intentionally allowing water to drain through the gasket, and wherein the gasket does not have notches about its outer perimeter.

54. The drain flange cover and strainer of embodiment 52, further comprising a plurality of standoffs on the underside or lower surface of the cap for spacing the cap away from the drain flange, and preferably further comprising centralizing fins or centering legs attached to the tubular shaft or to the cap for maintaining the tubular shaft in the center of the drain pipe.

55. The drain flange cover and strainer of embodiment 52, 53 or 54, wherein the sheet of material has a finish selected from the group consisting of polished chrome, brushed chrome, bronze, oil-rubbed bronze, polished bronze, brushed nickel, polished nickel, polished brass, satin brass, satin bronze, copper, matte black and white.

56. The drain flange cover and strainer of embodiment 55, wherein the tubular shaft has a circular cylindrical shape or a conical shape, preferably further comprising a plurality of standoffs on the underside of the cap for spacing the cap away from the drain flange so that water can flow under the cap and into the drain pipe, and preferably further comprising centralizing fins attached to the tubular shaft or centering legs attached to the underside of the cap for positioning the tubular shaft in approximately the center of the drain pipe, wherein the standoffs and the centralizing fins can be a combined plurality of spacer-centralizer elements.

57. The drain flange cover and strainer of any one of embodiments 48-56, wherein the cap and the tubular shaft are rigid.

58. A drain stopper for a bathtub or a sink having a drain opening and a drain pipe having a drain flange attached to the bathtub or the sink at the drain opening, comprising:

an open-close mechanism having a longitudinal axis and upper and lower ends, wherein the open-close mechanism is a push-push mechanism or a lift-and-lock mechanism or a lift-and-turn mechanism;

a cap engaged with the upper end of the open-close mechanism;

a seal engaged with the cap for providing a seal with the drain flange or the drain pipe;

a disk engaged with the lower end of the open-close mechanism;

a strainer surrounding the open-close mechanism, wherein the strainer rests on or is formed integral with or is attached to the disk, wherein the strainer has a plurality of openings through which water can flow, wherein an outer annular space is defined between the drain pipe and the strainer, wherein an inner space is defined in part by an inner surface of the strainer, wherein the disk does not have an opening through which water can drain from the outer annular space, and wherein the disk has one or more openings through which water can drain from the inner space, thereby forcing water to flow from the outside of the strainer to the inside of the strainer. Alternatively, the drain stopper does not include the strainer, or the strainer operates to catch hair, debris and objects inside the strainer.

59. The drain stopper of embodiment 58, wherein the cap has a diameter at its widest point, wherein the seal has a diameter at its widest point, and wherein the diameter of the cap is greater than the diameter of the seal.

60. The drain stopper of embodiment 58, wherein the disk has a perimeter that comprises a gasket for providing a seal against an inside surface of the drain pipe.

61. The drain stopper of embodiment 58, further comprising means for anchoring the open-close mechanism in the drain pipe, wherein the lower end of the open-close mechanism is engaged with the means for anchoring.

62. The drain stopper of embodiment 61, wherein the means for anchoring the open-close mechanism in the drain pipe is selected from the group consisting of:

male threads on the lower end of the push mechanism for threading into a tub shoe that has cross bars with an opening defined by female threads;

an anchor comprising a base and a set of prongs, wherein the base is in threaded engagement with the lower end of the open-close mechanism, and wherein the prongs have a catch mechanism for engaging a tub shoe that has cross bars; and the disk, wherein the disk is designed and sized for a friction engagement with an inside surface of the drain pipe.

63. The drain stopper of embodiment 58, wherein the drain stopper has a length, wherein the cap is in a threaded engagement with the open-close mechanism, and wherein the length can be adjusted by the amount of threaded engagement.

64. The drain stopper of embodiment 63, wherein the cap has a bore defined by female threads, wherein the upper end of the open-close mechanism has male threads that are received in the bore of the cap, further comprising a lock nut having female threads received on and in threaded engagement with the upper end of the open-close mechanism, wherein the lock nut can be moved into a tight friction abutment with the cap for holding the length of the drain stopper constant.

65. The drain stopper of embodiment 58, wherein the cap has a diameter at its widest point, wherein the seal has a diameter at its widest point, and wherein the diameter of the cap is 10 to 50 percent greater than the diameter of the seal.

66. The drain stopper of claim 12, wherein the disk has a perimeter that comprises a gasket for providing a seal against an inside surface of the drain pipe, wherein the gasket has a diameter at its widest point, wherein the cap has a diameter at its widest point, and wherein the diameter of the cap is at least 0.5 inch greater than the diameter of the gasket, preferably at least 1.0 inch greater.

67. The drain stopper of embodiment 58, wherein a two-prong fork is substituted for the disk on the lower end of the drain stopper for anchoring the drain stopper to a rod that protrudes into a drain pipe through a pivot rod port.

68. A drain flange cover and strainer for a sink or a bathtub that has a drain opening, wherein a drain pipe and a drain flange are sealed about the drain opening, the drain flange cover and strainer comprising:

a perforated tube that has a longitudinal axis and opposing upper and lower ends, wherein the perforated tube is generally cylindrical or generally conical in shape, wherein the perforated tube is rigid, and wherein the perforated tube functions as the strainer;

a cap attached directly or indirectly to the upper end, wherein the cap functions as the drain flange cover;

a flange received on the lower end, wherein the flange projects radially with respect to the longitudinal axis, and wherein the diameter of the cap is greater than the diameter of the flange; and a standoff for spacing the cap from the drain flange so that the drain flange cover cannot operate as a drain stopper.

69. The drain flange cover and strainer of claim 68, further comprising means for centralizing the perforated tube in the drain pipe.

70. The drain flange cover and strainer of claim 68 or 69, wherein the cap is sized and designed to cover and hide the drain flange, further comprising a plating or a sheet of a material covering the upper and outer surface of the cap, preferably wherein the plating or sheet of material has a finish selected from the group consisting of polished chrome, brushed chrome, bronze, oil-rubbed bronze, polished bronze, brushed nickel, polished nickel, polished brass, satin brass, satin bronze, copper, matte black and white, any color, an emblem, a character and a design.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A drain flange cover and strainer for covering a drain flange around a drain opening in a sink or bathtub and/or for straining hair, debris and objects out of drain water, comprising:

a cap having an upper and outer surface and an opposing underside, wherein the upper and outer surface of the cap is solid and does not have holes or openings so that water does not flow through the cap, wherein the underside of the cap has a first set of threads, and wherein the cap is sized to at least partially cover the drain flange;

a perforated tubular shaft having a sidewall that defines a central drain space, an upper end attached to the cap and an opposing lower end that is open or that has openings through which water can flow, wherein the upper end has a second set of threads on an inside surface or on an outside surface of the upper end of the tubular shaft, wherein the second set of threads is engaged with the first set of threads by rotating the cap with respect to the tubular shaft, wherein the perforated tubular shaft projects downwardly from the underside of the cap while in a drain pipe, and wherein the sidewall of the tubular shaft has openings sized and designed to filter out hair, debris and objects while allowing water to pass through the openings into the central drain space and down and out through the lower end;

a gasket holder attached to or formed integral with the lower end of the shaft; and a gasket removably engaged with the gasket holder, wherein the gasket is sized and designed to touch an inside wall of the drain pipe, thereby causing water to flow through the openings in the sidewall of the tubular shaft and into the central drain space so that the hair, debris and objects collect on an outside surface of the sidewall.

2. The drain flange cover and strainer of claim 1, wherein the first set of threads are formed integral with the cap, and wherein the second set of threads are formed integral with the tubular shaft.

3. The drain flange cover and strainer of claim 1, wherein the gasket holder is a flange that has a circumferential perimeter, wherein the perimeter has a circumferential groove, wherein the gasket is received in the groove, and wherein the gasket provides a seal between the gasket holder and the inside wall of the drain pipe.

4. The drain flange cover and strainer of claim 1, wherein the cap does not have a seal for retaining water in the sink or bathtub, wherein the drain flange cover and strainer is not designed or configured for use as a drain stopper for retaining water in the sink or bathtub, and wherein the cap and the perforated tubular shaft are rigid.

5. The drain flange cover and strainer of claim 1, further comprising a plurality of standoffs on the underside of the cap for spacing the cap away from the drain flange so that water can flow under the cap and into the drain pipe.

6. The drain flange cover and strainer of claim 1, further comprising a plurality of spacer-centralizer elements attached to or formed integral with the cap and/or the tubular shaft that maintain an open space between the underside of the cap and the drain flange and that position the tubular shaft in approximately the center of the drain pipe.

7. The drain flange cover and strainer of claim 1, wherein the gasket comprises a ring-shaped body, wherein the gasket has the shape of a flange that extends radially with a taper or is an O-ring.

8. The drain flange cover and strainer of claim 1, wherein the tubular shaft has a conical shape.

9. The drain flange cover and strainer of claim 1, wherein the cap does not have a sealing element for retaining water in the sink or the bathtub, wherein the second set of threads is on the outside surface of the upper end of the tubular shaft, wherein the perforated tubular shaft is designed and sized with a length for resting on cross-bars in a bathtub drain and holding the cap above and spaced away from the drain flange so that water will drain out of the bathtub, wherein the gasket holder is a flange that has a circumferential perimeter, wherein the perimeter has a circumferential groove, wherein the gasket is received in the groove, and wherein the cap and the perforated tubular shaft are rigid.

10. The drain flange cover and strainer of claim 1, wherein the underside of the cap has a short tube with a bore defined by female threads, and wherein the second set of threads is on the outside surface of the perforated tubular shaft.

11. The drain flange cover and strainer of claim 10, wherein the cap and the gasket each have a diameter, and wherein the diameter of the cap is at least about 0.75 inch greater than the diameter of the gasket so that the cap will cover and hide the drain flange.

12. The drain flange cover and strainer of claim 1, wherein the cap is sized to cover the drain flange, wherein the cap and the perforated tubular shaft are rigid, and wherein the perforated tubular shaft has a slightly conical shape.

13. A strainer for a sink or bathtub having a drain opening, a drain flange above the drain opening and a drain pipe below and connected to the drain flange, the strainer comprising:

a cap having an upper and outer surface and an opposing underside, wherein the cap is sized and designed to remain above the drain flange, wherein the upper and outer surface of the cap is solid and does not have holes or openings so that water does not flow through the cap, and wherein the underside of the cap has a bore defined by interior threads;

a perforated tubular shaft having an upper end and an opposing lower end that is open or that has openings through which water can flow, wherein the upper end has threads on its outside surface that are engaged with the interior threads of the cap by rotating the cap with respect to the tubular shaft, and wherein:

the tubular shaft projects downwardly from the underside of the cap and is sized and designed to fit within the drain pipe, the tubular shaft has openings sized and designed to filter out hair, debris and objects while allowing water to pass through the openings, the tubular shaft has a circular cylindrical shape, a regular funnel shape or an inverted funnel shape, and wherein the perforated tubular shaft has a gasket holder on the lower end of the tubular shaft; and a gasket detachably attached to the gasket holder, wherein the cap and the tubular shaft are rigid.

14. A kit for a bathtub drain strainer comprising:

a cap having an underside and a solid upper surface, wherein there is no hole through the cap, and wherein the underside has interior or exterior cap threads formed integrally with or cut into the underside;

a perforated tubular shaft having an upper end, wherein the upper end has interior or exterior threads formed integrally with or cut into the upper end for matingly engaging with the cap threads by rotating the tubular shaft with respect to the cap, and wherein the perforated tubular shaft has a lower end and a gasket holder on the lower end; and two or more different gaskets sized and designed to detachably engage with the gasket holder, wherein the two or more different gaskets have two or more different outside diameters, wherein at least one gasket is sized and designed to provide a seal in a first drain pipe having a first inside diameter, and wherein at least one other gasket is sized and designed to provide a seal in a second drain pipe having a second inside diameter.

15. The kit of claim 14, wherein the cap has interior cap threads, and wherein the cap does not have a sealing element.

16. A drain flange cover and strainer for covering a drain flange around a drain opening in a sink or bathtub and/or for straining hair, debris and objects out of drain water, comprising:

a cap having an upper and outer surface and an opposing underside, wherein the upper and outer surface of the cap is solid and does not have holes or openings so that water does not flow through the cap, wherein the underside of the cap has a first set of threads formed integral with the cap, and wherein the cap does not have a sealing element for retaining water in the sink or bathtub;

a perforated tubular shaft having an upper end, an opposing lower end that is open or that has openings through which water can flow and a sidewall that defines a central drain space, wherein the upper end has a second set of threads formed integral with the tubular shaft, wherein the second set of threads are engaged with the first set of threads by rotating one set of threads with respect to the other set of threads, wherein the perforated tubular shaft projects downwardly from the underside of the cap while in a drain pipe, and wherein the sidewall of the tubular shaft has openings sized and designed to filter out hair, debris and objects while allowing water to pass through the openings into the central drain space and down and out through the lower end;

a gasket holder attached to or formed integral with the lower end of the shaft; and a gasket, removably engaged with the gasket holder, wherein the gasket is sized and designed to touch an inside wall of the drain pipe, thereby causing water to flow through the openings in the sidewall of the tubular shaft and into the central drain space so that the hair, debris and objects collect on an outside surface of the sidewall.

17. A drain flange cover and strainer for covering a drain flange around a drain opening in a sink or bathtub and/or for straining hair, debris and objects out of drain water, comprising:

a cap having an upper and outer surface and an opposing underside, wherein the upper and outer surface of the cap is solid and does not have holes or openings so that water does not flow through the cap, and wherein the cap is sized to at least partially cover the drain flange;

a perforated tubular shaft having a sidewall that defines a central drain space, an upper end attached to or formed integral with the cap and an opposing lower end that is open or that has openings through which water can flow, wherein the perforated tubular shaft projects downwardly from the underside of the cap while in a drain pipe, and wherein the sidewall of the tubular shaft has openings sized and designed to filter out hair, debris and objects while allowing water to pass through the openings into the central drain space and down and out through the lower end;

a gasket holder attached to or formed integral with the lower end of the shaft; and a gasket removably engaged with the gasket holder, wherein the gasket is sized and designed to touch an inside wall of the drain pipe, thereby causing water to flow through the openings in the sidewall of the tubular shaft and into the central drain space so that the hair, debris and objects collect on an outside surface of the sidewall, wherein the drain flange cover and strainer is not designed or configured for use as a drain stopper for retaining water in the sink or bathtub.

18. The drain flange cover and strainer of claim 17, wherein the underside of the cap has a first set of threads, wherein the upper end of the perforated tubular shaft has a second set of threads on an inside surface or on an outside surface of the upper end of the tubular shaft, wherein the second set of threads is engaged with the first set of threads by rotating the cap with respect to the tubular shaft, and wherein the first set of threads are formed integral with the cap, and wherein the second set of threads are formed integral with the tubular shaft.

* * * * *